US010399335B2

(12) United States Patent
Okui et al.

(10) Patent No.: US 10,399,335 B2
(45) Date of Patent: Sep. 3, 2019

(54) LIQUID EJECTING HEAD AND LIQUID EJECTING APPARATUS

(71) Applicant: SEIKO EPSON CORPORATION, Tokyo (JP)

(72) Inventors: Hiroaki Okui, Azumino (JP); Daisuke Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/958,262

(22) Filed: Apr. 20, 2018

(65) Prior Publication Data

US 2018/0311957 A1 Nov. 1, 2018

(30) Foreign Application Priority Data

Apr. 26, 2017 (JP) ..... 2017-086950

(51) Int. Cl.
*B41J 2/14* (2006.01)
*B41J 2/16* (2006.01)
*B41J 2/155* (2006.01)

(52) U.S. Cl.
CPC ..... *B41J 2/14201* (2013.01); *B41J 2/1433* (2013.01); *B41J 2/14233* (2013.01); *B41J 2/155* (2013.01); *B41J 2/1607* (2013.01); *B41J 2002/14241* (2013.01); *B41J 2002/14362* (2013.01); *B41J 2002/14419* (2013.01); *B41J 2002/14491* (2013.01); *B41J 2202/19* (2013.01); *B41J 2202/20* (2013.01); *B41J 2202/21* (2013.01)

(58) Field of Classification Search
CPC .. B41J 2/14201; B41J 2/14233; B41J 2/1433; B41J 2/155; B41J 2/1607; B41J 2202/20; B41J 2202/21; B41J 2202/19; B41J 2002/14419; B41J 2002/14362; B41J 2002/14241; B41J 2002/14491
USPC ..... 347/50
See application file for complete search history.

(56) References Cited

U.S. PATENT DOCUMENTS

| | | | | |
|---|---|---|---|---|
| 6,206,499 | B1 * | 3/2001 | Iijima | B41J 2/14024 347/20 |
| 8,622,526 | B2 * | 1/2014 | Munakata | B41J 2/1433 347/68 |
| 2003/0067514 | A1 * | 4/2003 | Okazawa | B41J 2/14274 347/70 |
| 2003/0146954 | A1 * | 8/2003 | Tamura | B41J 2/04541 347/50 |
| 2008/0099887 | A1 | 5/2008 | Song et al. | |
| 2016/0089879 | A1 * | 3/2016 | Tanaka | B41J 2/04541 347/10 |

FOREIGN PATENT DOCUMENTS

| | | |
|---|---|---|
| JP | H11-291465 A | 10/1999 |
| JP | 2008-112992 A | 5/2008 |

* cited by examiner

*Primary Examiner* — Huan H Tran
*Assistant Examiner* — Alexander D Shenderov
(74) *Attorney, Agent, or Firm* — Workman Nydegger

(57) ABSTRACT

There are provided a head chip which ejects a liquid based on an electric signal; a first conductive path for connecting the head chip to a ground on the outside of a liquid ejecting head; and a second conductive path for connecting a shield of the head chip to the ground.

20 Claims, 12 Drawing Sheets

LIQUID EJECTING HEAD AND LIQUID EJECTING APPARATUS

BACKGROUND

1. Technical Field

The present invention relates to a liquid ejecting head and a liquid ejecting apparatus for ejecting a liquid from a nozzle, particularly to an ink jet type recording head and an ink jet type recording apparatus for ejecting ink as a liquid.

2. Related Art

A liquid ejecting apparatus represented by an ink jet type recording apparatus, such as an ink jet type printer or plotter, includes a liquid ejecting head that is capable of ejecting a liquid, such as ink stored in a cartridge, a tank or the like.

A liquid ejecting head includes: a head chip having a nozzle opening for ejecting the liquid and a pressure generating element for causing a pressure change in a flow path that communicates with the nozzle opening; and a driving circuit having a switching element for driving the pressure generating element.

In such a liquid ejecting head, a metal cover having a shielding function of a driving circuit is grounded to a printed circuit board, and a driving circuit or a pressure generating element of the head chip is grounded to the printed circuit board (for example, refer to JP-A-11-291465).

However, there is a problem that noise or the like picked up by a metal cover via the printed circuit board is transferred to a head chip, and there is a concern that malfunction or destruction of the pressure generating element or a switching element of the head chip is caused.

In addition, such a problem is not limited to the ink jet type recording head, and also exists in a liquid ejecting head that ejects the liquid other than ink.

SUMMARY

An advantage of some aspects of the invention is to provide a liquid ejecting head and a liquid ejecting apparatus which are capable of suppressing malfunction or destruction caused by noise or static electricity of a head chip.

According to an aspect of the invention, there is provided a liquid ejecting head including: a head chip which ejects a liquid based on an electric signal; a first conductive path for connecting the head chip to a ground on the outside of the liquid ejecting head; and a second conductive path for connecting a shield of the head chip to the ground.

In this case, by connecting the shield to the ground by the second conductive path, it is possible to suppress radiation of noise from the inside of the head chip to the outside, and to protect the head chip from the outside noise and static electricity. In addition, by providing the first conductive path and the second conductive path, it is possible to prevent the first conductive path and the second conductive path from conducting with each other on the inside of the liquid ejecting head, to suppress transmission of static electricity or noise from the shield to the head chip via the second conductive path and the first conductive path, and to suppress malfunction or destruction of the pressure generating element or the switching element incorporated in the head chip due to static electricity or noise.

In the liquid ejecting head, it is preferable that the shield be a conductive member formed of a conductive material provided between the head chip and an ejecting medium onto which the liquid ejected by the head chip is landed. According to this, it is possible to protect the head chip from noise or static electricity from the ejecting medium by the shield which is a conductive member.

In the liquid ejecting head, it is preferable that a plurality of the head chips and a plurality of the conductive members be provided, the plurality of conductive members be disposed in a state of being separated from each other, and the conductive members which are mutually adjacent be conducted to each other by a conductor, in other words, a void conduction portion. According to this, it is possible to suppress poor connection of the conductive member to the ground, and suppress generation of amplification and directivity of the conductive member similar to the loop antenna in a direction in which the conductive members are aligned in parallel.

In addition, it is preferable that the first conductive path and the second conductive path be conducted to each other via a noise canceller, in other words, a noise removing component. According to this, it is difficult for noise or static electricity to be transmitted to the first conductive path via the second conductive path, and it is possible to suppress malfunction or destruction due to noise or static electricity of the head chip.

According to another aspect of the invention, there is provided a liquid ejecting apparatus including: the liquid ejecting head according to above-described aspect and an apparatus main body which supports the liquid ejecting head.

In this case, it is possible to realize a liquid ejecting apparatus in which malfunction or destruction of the head chip is suppressed.

In the liquid ejecting apparatus, it is preferable that the liquid ejecting head and the apparatus main body be connected to each other via an attachable and detachable connector. According to this, it is possible to easily attach and detach the liquid ejecting head from the apparatus main body. In addition, after the liquid ejecting head is mounted on the apparatus main body, it is possible to easily connect the liquid ejecting head to the ground via the connector.

In the liquid ejecting apparatus, it is preferable that the liquid ejecting head be provided so as to be relatively movable with respect to the apparatus main body. According to this, it is possible to respond to various types of ejecting medium, and it is possible to reduce the size of the liquid ejecting head and the apparatus main body.

It is preferable that the liquid ejecting apparatus further include a circuit board having the ground. According to this, it is possible to connect at least one of the first conductive path and the second conductive path to the ground of the circuit board.

In the liquid ejecting apparatus, it is preferable that the first conductive path be connected to the earth or connected to the ground by an outlet plug, and the second conductive path be connected to the earth. According to this, by grounding the second conductive path, it is possible to reliably protect the head chip by the shield from the external noise or static electricity, and to suppress radiation of noise from the head chip to the outside.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
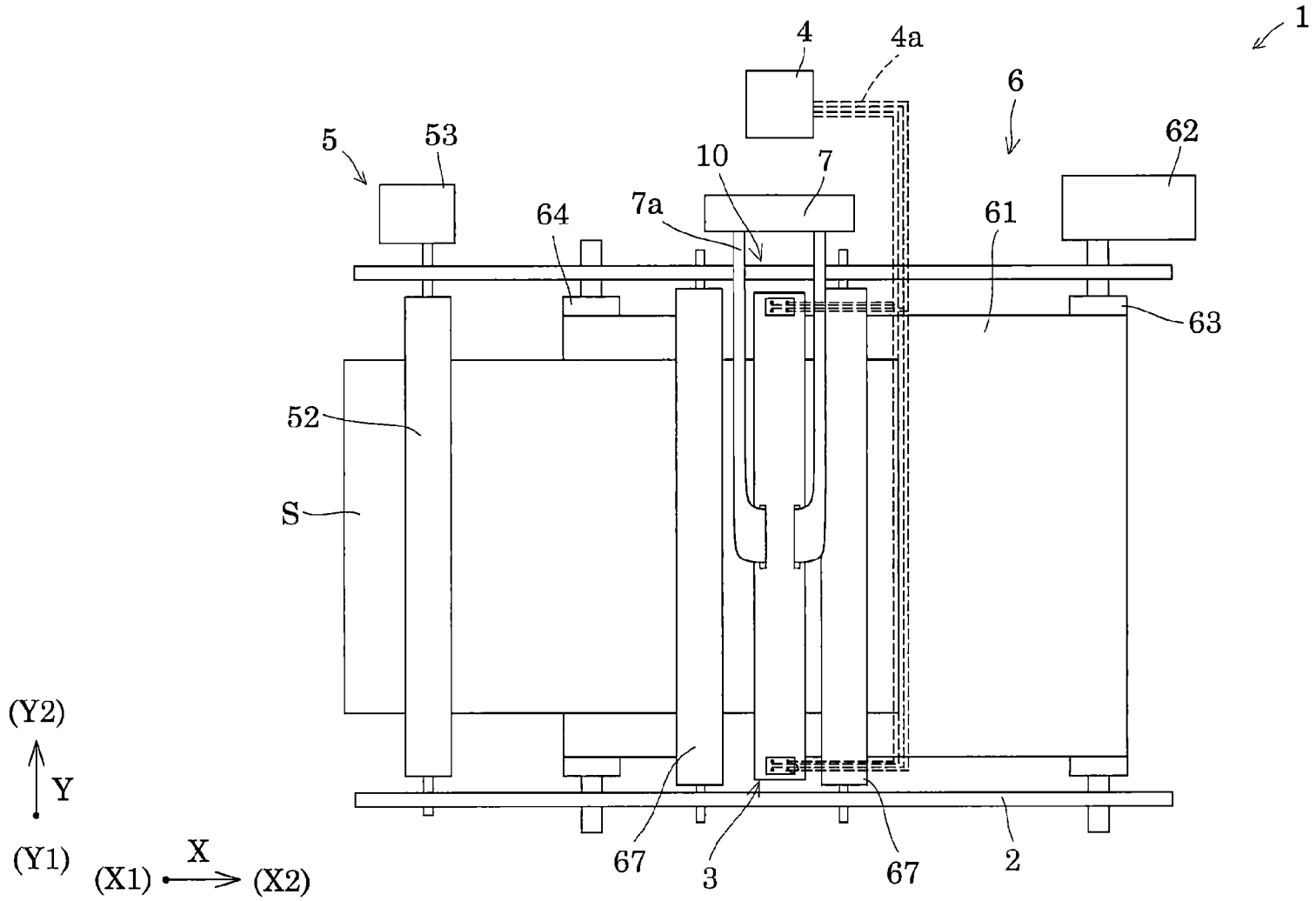
FIG. 1 is a top view illustrating a schematic configuration of a recording apparatus according to Embodiment 1 of the invention.
Figure 2:
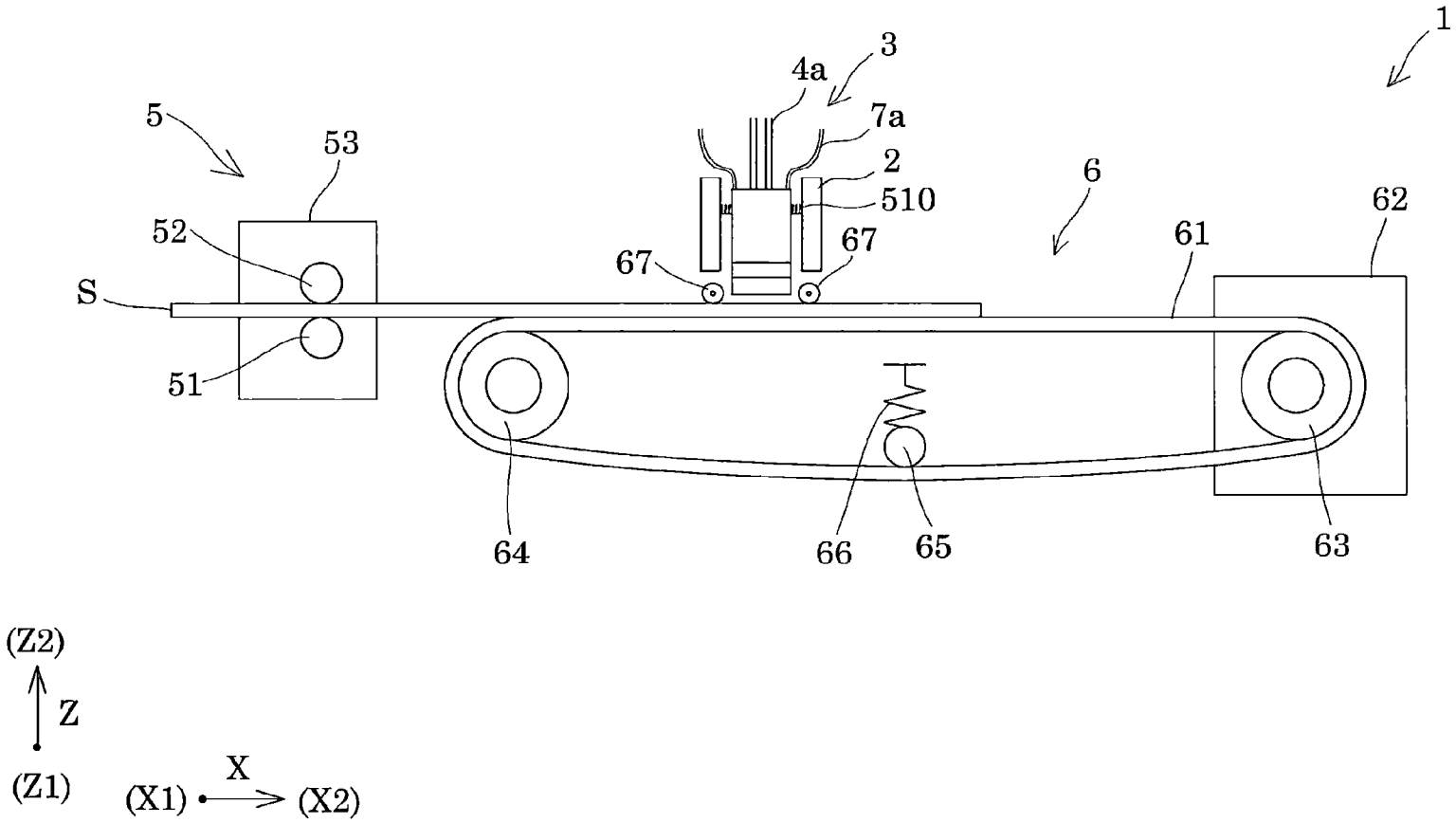
FIG. 2 is a side view illustrating a schematic configuration of the recording apparatus according to Embodiment 1 of the invention.

FIG. 1 is a top view illustrating a schematic configuration of an ink jet type recording apparatus which is an example of a liquid ejecting apparatus according to Embodiment 1 of the invention, and FIG. 2 is a side view of the ink jet type recording apparatus.

As illustrated in the drawing, an ink jet type recording apparatus 1 which is an example of the liquid ejecting apparatus of the embodiment is a so-called line type recording apparatus which performs printing only by transporting a recording sheet S that is an ejecting medium.

Here, in the embodiment, the transport direction of the recording sheet S is referred to as a first direction X, and the recording sheet S is transported from an X1 side to an X2 side in the first direction X. In addition, in an in-plane direction of a surface on which the ink of the recording sheet S lands, a direction orthogonal to the first direction X is referred to as a second direction Y, one end side in the second direction Y is referred to as Y1 and the other end side is referred to as Y2. Furthermore, a direction orthogonal to both the first direction X and the second direction Y, that is, a direction orthogonal to the surface on which the ink of the recording sheet S lands is referred to as a third direction Z. In addition, in the third direction Z, the liquid ejecting direction side (recording sheet S side with respect to the recording head 3) is referred to as Z1, and a side opposite thereto is referred to as Z2. In the embodiment, a case where each orientation (X, Y, and Z) is orthogonal to each other is exemplified, but the invention is not necessarily limited thereto.

The ink jet type recording apparatus 1 includes an apparatus main body 2 which is a main body frame having conductivity, an ink jet type recording head 3 (hereinafter, also simply referred to as a recording head 3), a storage unit 4, and a first transport unit 5 and a second transport unit 6 which transport the recording sheet S.

The recording head 3 ejects ink droplets from the surface on the Z1 side, and is supported by the apparatus main body 2. In addition, although not specifically illustrated, the recording head 3 is provided so as to be relatively movable in the third direction Z with respect to the apparatus main body 2. In this manner, by making it possible to relatively move the recording head 3 in the third direction Z with respect to the apparatus main body 2, it is possible to adjust the distance between the recording sheet S and a nozzle surface onto which the ink droplets of the recording head 3 are ejected. In addition, the distance between the recording sheet S and the recording head 3 may be adjusted, for example, based on the thickness of the recording sheet S on which the ink droplet lands, or may be adjusted based on the printing speed. In addition, although not specifically illustrated, the recording head 3 may be provided so as to be relatively movable in the second direction Y with respect to the apparatus main body 2. By relatively moving the recording head 3 in the second direction Y with respect to the apparatus main body 2, it is possible to easily cover the nozzle surface of the recording head 3 with a cap member (not illustrated), or to easily perform maintenance, such as wiping with a wiper. It is needless to say that the maintenance of the recording head 3 is not limited to the relative movement in the second direction Y with respect to the apparatus main body 2, but may be a relative movement in the third direction Z with respect to the apparatus main body 2, a relative movement in the first direction X.

The storage unit 4 supplies ink to the recording head 3 as a liquid, and in the embodiment, the storage unit 4 is fixed to the apparatus main body 2. Ink from the storage unit 4 fixed to the apparatus main body 2 is supplied to the recording head 3 via a supply pipe 4*a*, such as a tube. In addition, an aspect in which the recording head 3 includes the storage unit 4, for example, the storage unit 4 may be loaded above the Z2 side of the recording head 3.

The first transport unit 5 is provided on one side in the first direction X of the recording head 3, and in the embodiment, on the X1 side. In addition, in the embodiment, in the first direction X, the upstream side in the transport direction with respect to the recording head 3 is referred to as the X1 side and the downstream side is referred to as the X2 side.

The first transport unit 5 includes a first transport roller 51 and a first driven roller 52 driven by the first transport roller 51. The first transport roller 51 is provided on a side opposite to the surface on which the ink lands on the recording sheet S, that is, on the Z1 side, and is driven by a driving force of the first driving motor 53. In addition, the first driven roller 52 is provided on the side on which the ink lands on the recording sheet S, that is, the Z2 side, and sandwiches the recording sheet S with the first transport roller 51. The first driven roller 52 presses the recording sheet S toward the first transport roller 51 by a biasing member, such as a spring (not illustrated).

The second transport unit 6 includes a transport belt 61, a second driving motor 62, a second transport roller 63, a second driven roller 64, a tension roller 65, and a pressing roller 67.

The second transport roller 63 of the second transport unit 6 is driven by the driving force of the second driving motor 62. The transport belt 61 is configured of an endless belt, and is hung at the outer circumference of the second transport roller 63 and the second driven roller 64. The transport belt 61 is provided on the Z1 side of the recording sheet S. The tension roller 65 is provided between the second transport roller 63 and the second driven roller 64, abuts against the inner circumferential surface of the transport belt 61, and applies tension to the transport belt 61 by a biasing force of a biasing member 66, such as a spring. Accordingly, in the transport belt 61, a surface that faces the recording head 3 between the second transport roller 63 and the second driven roller 64 is disposed to be flat.

The pressing roller 67 of the second transport unit 6 is provided on the X1 side and the X2 side of the recording head 3 on the Z2 side of the recording sheet S. By sandwiching the recording sheet S between the two pressing rollers 67 and the transport belt 61, the posture of the recording sheet S is held to be flat.

In the ink jet type recording apparatus 1, while transporting the recording sheet S toward the recording head 3 in the first direction X from the X1 to the X2 side by the first transport unit 5 and the second transport unit 6, ink is ejected from each of the head main bodies 100 of the recording head 3, and the ejected ink lands on the surface on the Z2 side of the recording sheet S, that is, so-called printing is performed.

Here, an example of the head main body of the embodiment used for the recording head 3 will be described with reference to FIGS. 3 and 4. In addition, FIG. 3 is an exploded perspective view of the head main body and a cover, and FIG. 4 is a sectional view of a part that corresponds to one arbitrary nozzle in the head chip.

Figure 3:
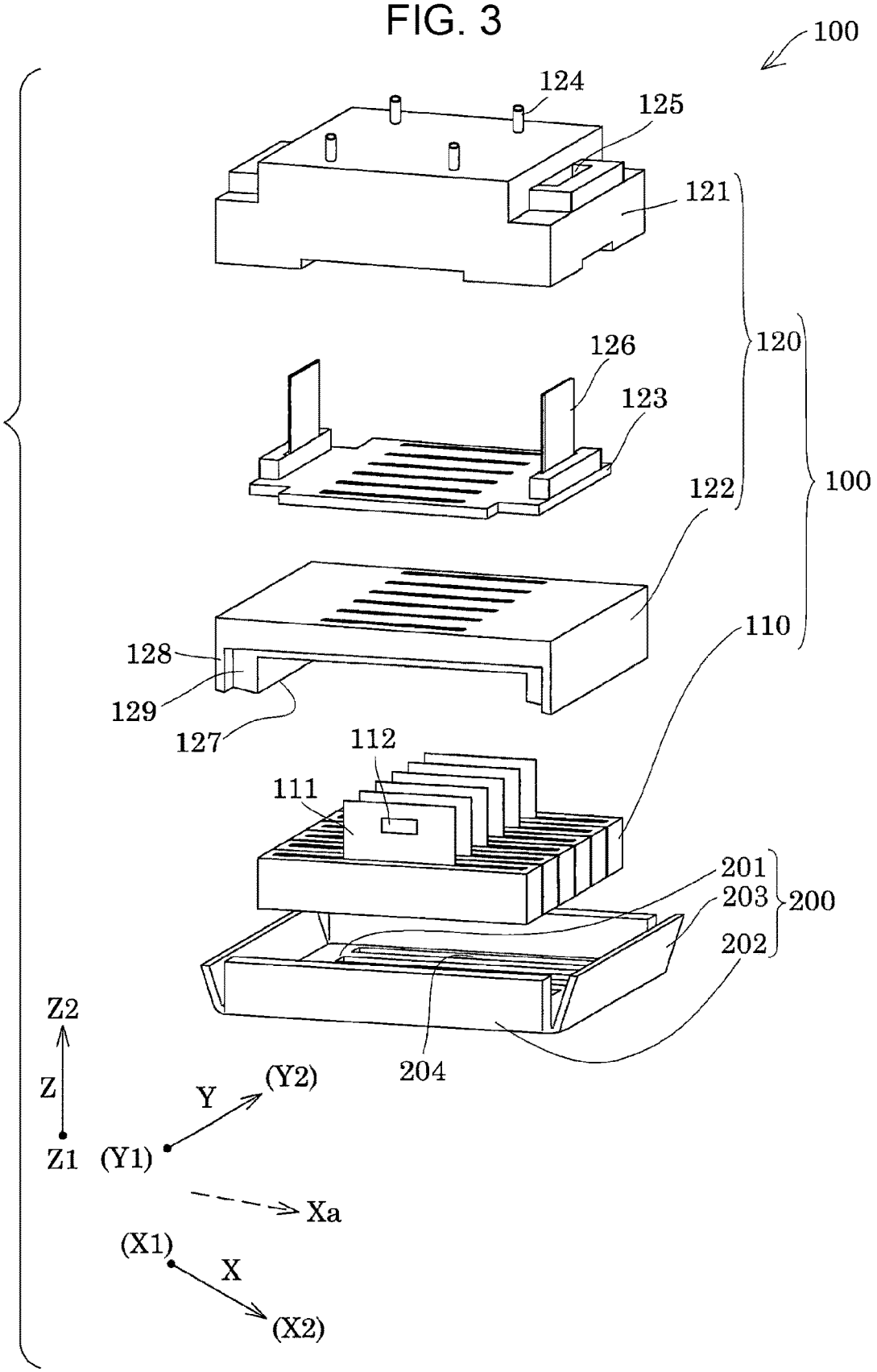
FIG. 3 is an exploded perspective view of a head main body according to Embodiment 1 of the invention.

As illustrated in FIG. 3, the head main body 100 includes a plurality of head chips 110 and a holding member 120 that holds a plurality of head chips 110.

Figure 4:
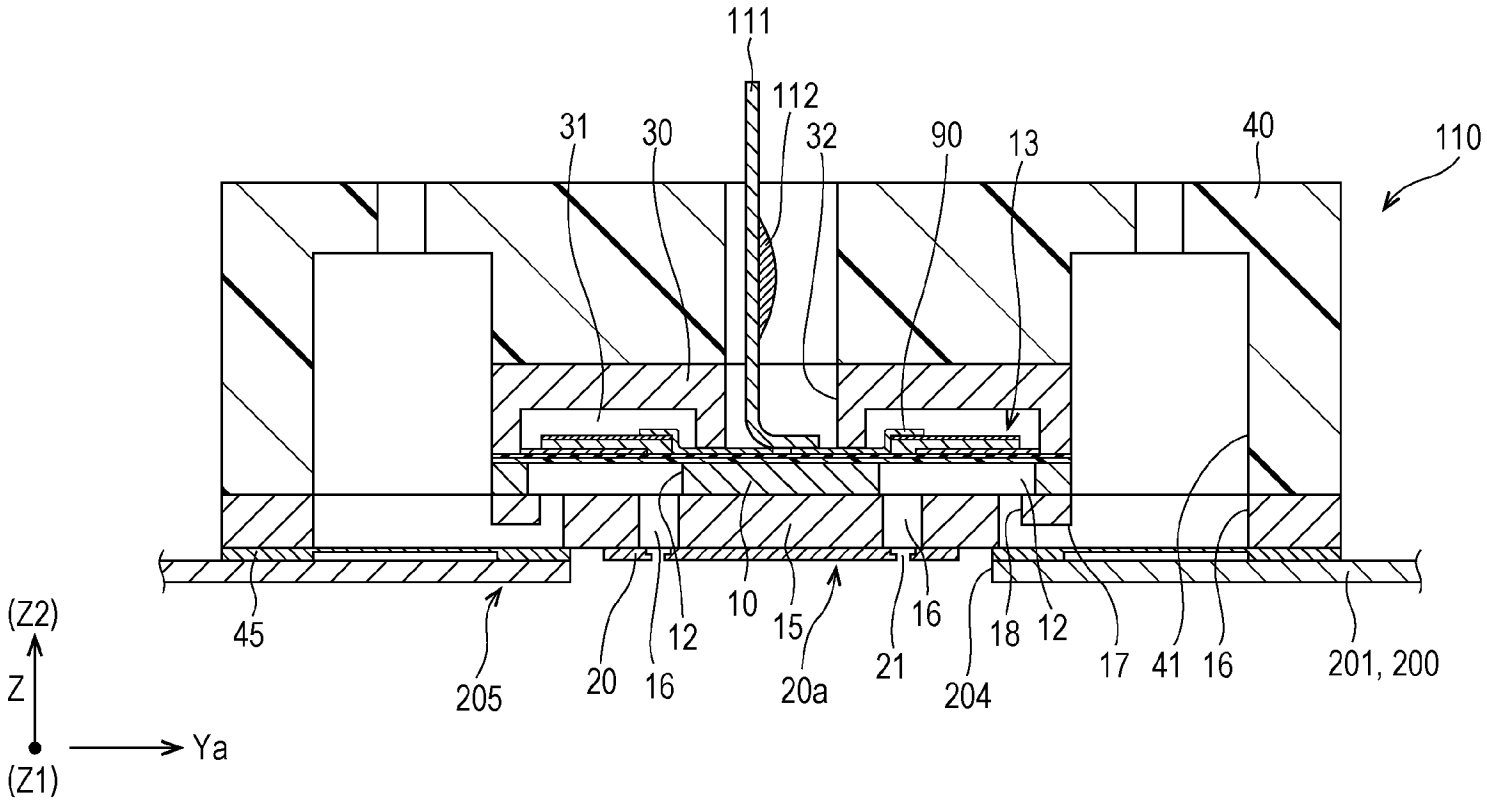
FIG. 4 is a sectional view of a head chip according to Embodiment 1 of the invention.

As illustrated in FIG. 4, the head chip 110 includes a plurality of members, such as a flow path forming substrate 10, a communication plate 15, a nozzle plate 20, a protective substrate 30, a compliance substrate 45, and a case 40, and the plurality of members are joined to each other by an adhesive or the like.

The flow path forming substrate 10, the communication plate 15, the nozzle plate 20, and the protective substrate 30 are formed of, for example, silicon flat plate material, and the case 40 is formed by injection molding of a resin material, for example.

In the flow path forming substrate 10, pressure generating chambers 12 partitioned by a plurality of partition walls are arranged in parallel along a direction in which a plurality of nozzle openings 21 are arranged in parallel. In addition, in the embodiment, the direction in which the pressure generating chambers 12 are arranged in parallel is identical to a fourth direction Xa which will be described later in detail (refer to FIG. 6). Further, on the flow path forming substrate 10, a plurality of rows in which the pressure generating chambers 12 are arranged in parallel in the fourth direction Xa are provided, and in the embodiment, two rows are provided. The arrangement direction in which a plurality of rows of the pressure generating chambers 12 in which the pressure generating chambers 12 are formed along the fourth direction Xa is hereinafter referred to as a fifth direction Ya. In the head chip 110 of the embodiment is loaded on the recording head 3 such that the fourth direction Xa which is the arrangement direction of the nozzle openings 21, becomes a direction inclined with respect to the first direction X that is the transport direction of the recording sheet S.

In addition, the communication plate 15 is joined to one surface side of the flow path forming substrate 10. The nozzle plate 20 in which a plurality of nozzle openings 21 that communicates with each of the pressure generating chambers 12 are formed, is joined to the communication plate 15. In the embodiment, the Z1 side which is one surface in the third direction Z in which the nozzle opening 21 of the nozzle plate 20 is opened, is a nozzle surface 20*a*.

The communication plate 15 is provided with an opening portion 16, a branched flow path 17 which is a throttle flow path, and a nozzle communication path 18. The branched flow path 17 and the nozzle communication path 18 are through-holes formed for each nozzle opening 21, and the opening portion 16 is an opening that is continuous across the plurality of nozzle openings 21.

In the case 40, a manifold 41 which is a common liquid chamber that communicates with the opening portion 16 of the communication plate 15, is formed. The manifold 41 is a space for storing the ink supplied to the plurality of nozzle openings 21, and is provided continuously across the plurality of nozzle openings 21, that is, the plurality of pressure generating chambers 12. The ink supplied to the manifold 41 is supplied into the pressure generating chamber 12 from the opening portion 16 via the branched flow path 17.

A nozzle opening 21 which communicates with each of the pressure generating chambers 12 via the nozzle communication path 18 is formed in the nozzle plate 20. In other words, the nozzle openings 21 are arranged in parallel in the fourth direction Xa for ejecting the ink which is the same kind of liquid, and two rows of nozzle openings 21 arranged in parallel in the fourth direction Xa are formed in the fifth direction Ya.

Meanwhile, a diaphragm is formed on a side opposite to the communication plate 15 of the flow path forming substrate 10. A first electrode, a piezoelectric layer, and a second electrode are sequentially laminated on the diaphragm, and accordingly, a piezoelectric actuator 13 which is the pressure generating element of the embodiment is configured. In general, one of the electrodes of the piezoelectric actuator 13 is used as a common electrode, and the other electrode and the piezoelectric layer are patterned for each of the pressure generating chambers 12 to form individual electrodes.

In addition, the protective substrate 30 is joined to the surface of the flow path forming substrate 10 on the piezoelectric actuator 13 side. The protective substrate 30 has a holding portion 31 which is a space for protecting the piezoelectric actuator 13. In addition, the protective substrate 30 and the case 40 are provided with through-holes 32 that penetrates in the third direction Z. An end portion of a lead electrode 90 drawn out from the electrode of the piezoelectric actuator 13 extends so as to be exposed in the through-hole 32, and the lead electrode 90 and a first wiring substrate 111 are electrically connected to each other in the through-hole 32. In addition, a driving circuit 112 in which switching elements, such as transmission gates, are provided on the inside for each of the piezoelectric actuators 13 is mounted on the first wiring substrate 111, and based on a head control signal input from the first wiring substrate 111, the switching element of the driving circuit 112 is open and closed to generate a driving signal at a desired timing. In addition, the driving signal generated by the driving circuit 112 is supplied to the piezoelectric actuator 13 via the first wiring substrate 111 and the lead electrode 90.

In addition, a compliance substrate 45 which closes the opening portion 16 is provided on the surface of the communication plate 15 on which the opening portion 16 is open. The pressure fluctuation in the opening portion 16 is absorbed by the flexible deformation of the compliance substrate 45.

In the head chip 110, the ink supplied to the manifold 41 is supplied into the pressure generating chamber 12 via the opening portion 16 and the branched flow path 17. In addition, by changing the pressure in the ink in the pressure generating chamber 12 by driving the piezoelectric actuator 13, the ink is ejected as ink droplets from the nozzle opening 21 that communicates with the pressure generating chamber 12 via the nozzle communication path 18.

A plurality of (in this embodiment, six) such head chips 110 are held by the holding member 120 to configure the head main body 100.

Here, as illustrated in FIG. 3, the holding member 120 which configures the head main body 100 includes a flow path member 121, a holder 122, and a second wiring substrate 123.

The flow path member 121 is provided with a flow path for supplying the ink supplied from a distribution flow path member 400 to the head chip 110 on the inside which is not illustrated. The flow path is provided on the surface on the Z2 side of the flow path member 121, and is provided being open to a tip end surface of a projection portion 124 that protrudes in the third direction Z. In the embodiment, four projection portions 124 are provided on the surface on the Z2 side of the flow path member 121. In other words, four independent flow paths are provided on the inside of the flow path member 121. In addition, a filter for removing foreign substances, such as dust or air bubbles contained in the ink may be provided in the middle of the flow path of the flow path member 121.

The holder 122 is fixed to the surface on the Z1 side of the flow path member 121. In the embodiment, the flow path member 121 and the holder 122 are laminated and fixed to each other in the third direction Z by a first head main body screw member 601 (refer to FIG. 8). In addition, the second wiring substrate 123 is held between the flow path member 121 and the holder 122. The second wiring substrate 123 is configured of a rigid substrate to which the first wiring substrates 111 of the plurality of head chips 110, in the embodiment, six head chips 110, are commonly electrically connected. In addition, although not specifically illustrated, electronic components, such as circuits for communication, are mounted on the second wiring substrate 123. In addition, in the embodiment, the driving circuit 112 having the switching element is provided on the first wiring substrate 111, but the invention is not particularly limited thereto, and a driving circuit having a switching element may be mounted on the second wiring substrate 123.

In addition, cable insertion holes 125 which penetrates in the third direction Z are provided in both of the end portions of the flow path member 121 in the first direction X, respectively. A first cable 126 inserted through the cable insertion hole 125 from the Z1 side of the flow path member 121 is connected to the second wiring substrate 123 held between the flow path member 121 and the holder 122.

In addition, the holder 122 has a holding portion 127 that forms a groove-like space on the Z1 side. The holding portion 127 is provided continuously on the Z1 side surface of the holding member 120 in the second direction Y so as to be open on both of the side surfaces in the second direction Y. In addition, the holding member 120 includes the holding portion 127 provided in the substantially center portion in the first direction X, so that a foot portion 128 is formed on both sides of the holding portion 127 in the first direction X. In other words, the foot portion 128 is provided only in both of the end portions in the first direction X on the surface on the Z1 side of the holding member 120, and is not provided in both of the end portions in the second direction Y.

Figure 7:
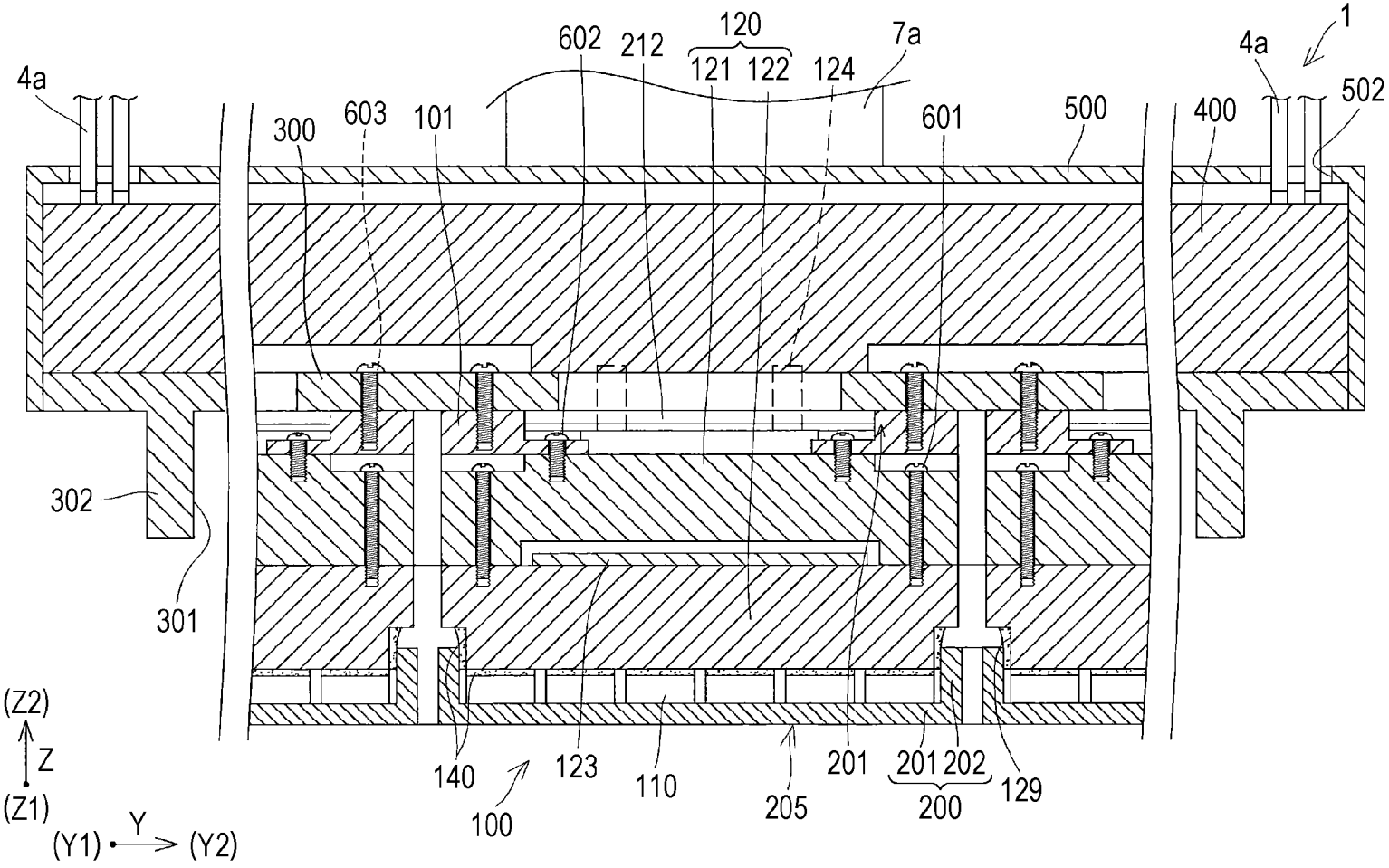
FIG. 7 is a sectional view of main portions of a recording head according to Embodiment 1.

A plurality of head chips 110 adhere to the holding portion 127 by an adhesive 140 (refer to FIG. 7). In other words, the foot portion 128 are positioned on both sides of the head chip 110 in the third direction Z. In addition, on the inside of the holder 122 (not illustrated), a flow path that communicates with a flow path provided on the inside of the flow path member 121 is provided. The ink supplied from the flow path member 121 is supplied to the plurality of head chips 110 via the flow path on the inside of the holder 122.

In addition, in the holding portion 127 of the holder 122, a plurality of head chips 110 are arranged in parallel in the second direction Y. In the embodiment, six head chips 110 adhere to one holding member 120. It is needless to say that the number of the head chips 110 to be fixed to one holding member 120 is not limited to the description above, and one head chip 110 may be employed, and two or more plural head chips 110 may be employed for one holding member 120. However, by providing a plurality of head chips 110 to one head main body 100 similar to the embodiment to achieve multi-row nozzle rows, it is possible to improve yield compared to a case where a plurality of nozzle rows are provided only in one head chip 110 to one head main body 100.

In addition, the plurality of head chips 110 of the embodiment are fixed such that the nozzle row is inclined with respect to the first direction X which is the transport direction of the recording sheet S in the in-plane direction of the nozzle surface 20*a*. In other words, in the first direction X, the fourth direction Xa which is the arrangement direction of the nozzle openings 21 that configures the nozzle row, is an inclined direction. In this manner, the fourth direction Xa which is the arrangement direction of the nozzle openings 21 of the head chip 110, is disposed to be inclined with respect to the first direction X, the plurality of head chips 110 are arranged in parallel in the second direction Y, and accordingly, it is possible to dispose at least a part of the nozzle openings 21 of the adjacent head chips 110 in the second direction Y at positions overlapping in the first direction X.

Figure 8:
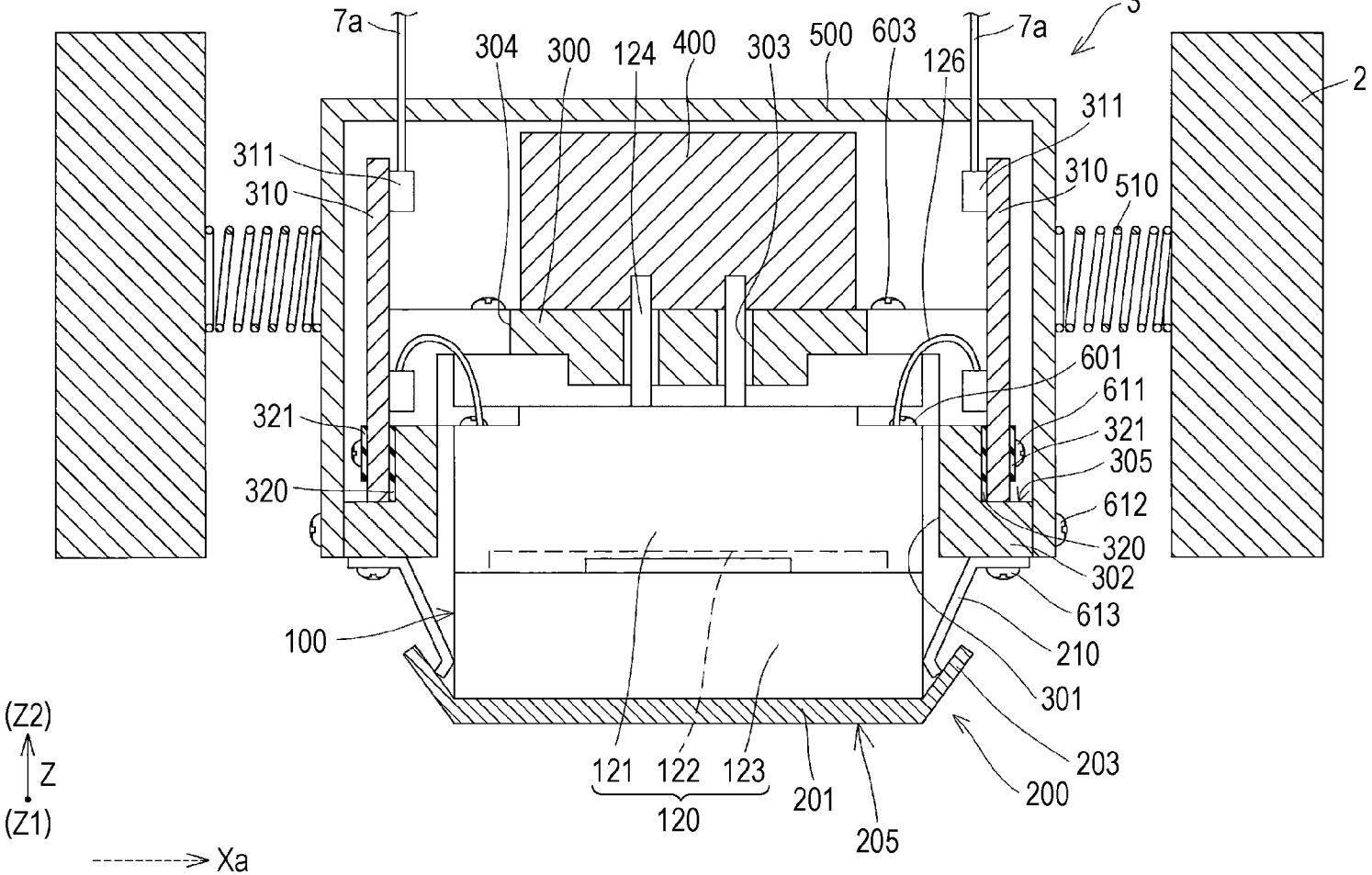
FIG. 8 is a sectional view of main portions of the recording head according to Embodiment 1.

The recording head 3 of the embodiment having the head main body 100 will be described with reference to FIGS. 5 to 8. In addition, FIG. 5 is an exploded perspective view illustrating an ink jet type recording head which is an example of a liquid ejecting head according to Embodiment 1 of the invention, FIG. 6 is a plan view of a liquid ejecting surface side of the ink jet type recording head, FIG. 7 is a sectional view of main portions taken along line VII-VII' of FIG. 6, and FIG. 8 is a sectional view of main portions taken along the line VIII-VIII' of FIG. 6.

Figure 5:
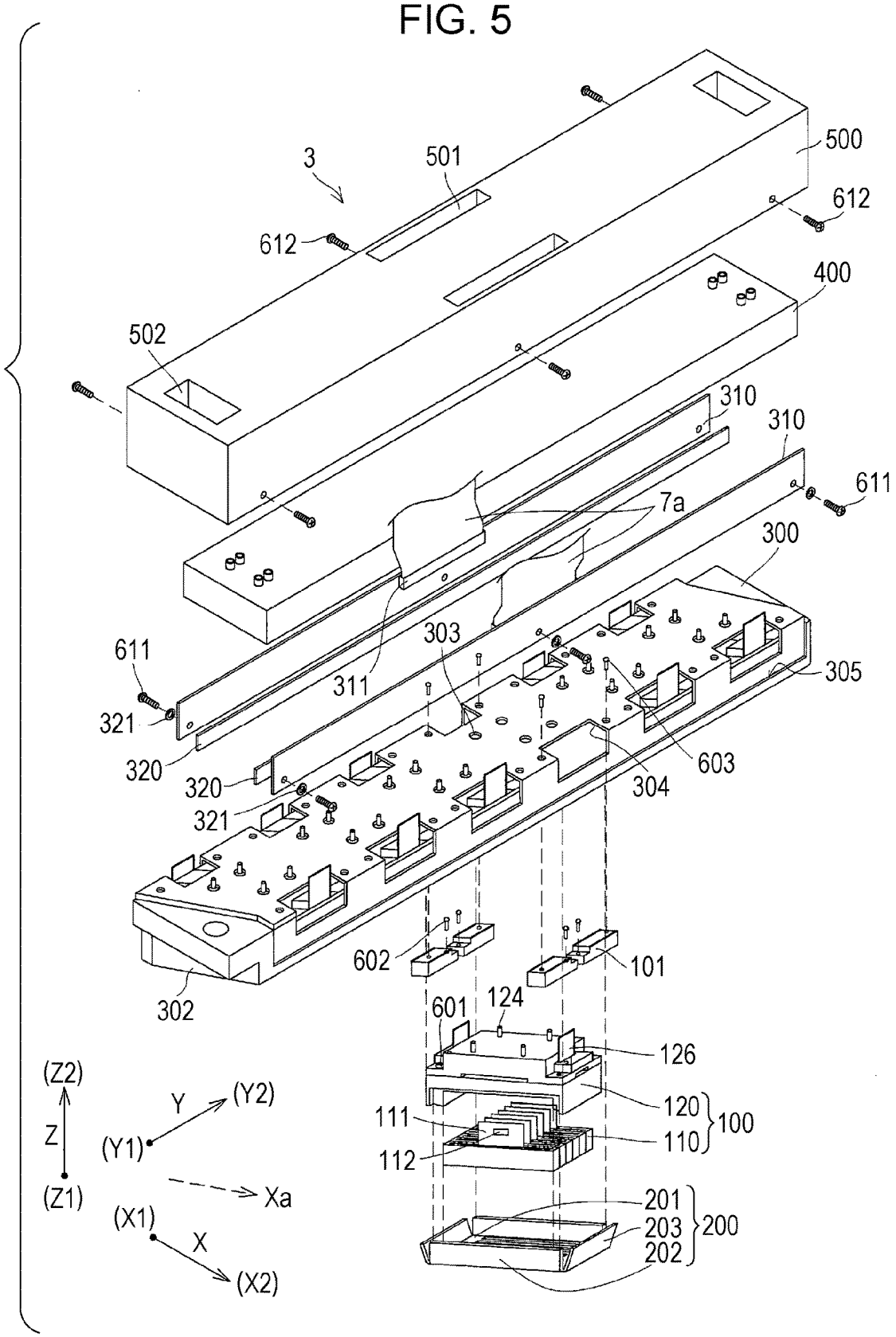
FIG. 5 is an exploded perspective view of a recording head according to Embodiment 1.
Figure 6:
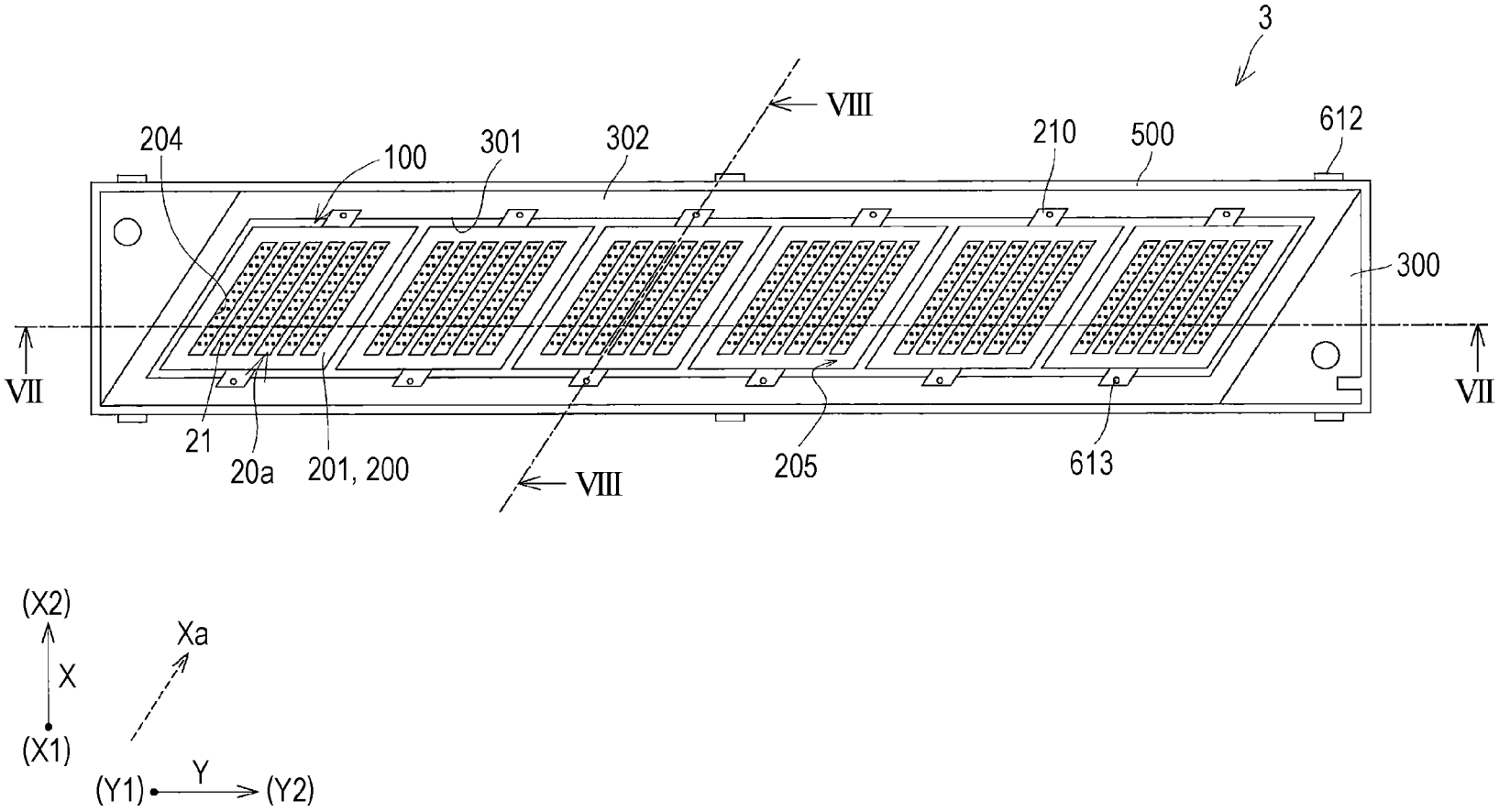
FIG. 6 is a plan view of a recording head according to Embodiment 1.

As illustrated in FIG. 5, the recording head 3 of the embodiment includes a plurality of the above-described head main bodies 100, a plurality of covers 200, a base 300, the distribution flow path member 400, and a base cover 500.

As illustrated in FIG. 3, the cover 200 is made of a conductive member formed of a material having conductivity, such as metal, for example, a plate-like member formed of stainless steel (SUS).

The cover 200 is provided on the nozzle surface 20*a* side of the plurality of head chips 110 provided in the head main body 100, that is, on the Z1 side in the third direction Z of the head main body 100. In other words, the cover 200 is provided between the head chip 110 and the recording sheet S on which the ink ejected by the head chip 110 lands, in the third direction Z which is the ink ejection direction. In addition, a case where the cover 200 is provided between the head chip 110 and the recording sheet S, means that the cover 200 is provided between at least one of the piezoelectric actuator 13 which is a pressure generating elements provided in the head chip 110 and that the driving circuit 112 having a switching element that drives the piezoelectric actuator 13, and the recording sheet S. In other words, even when the cover 200 is positioned further on the Z2 side than the end portion on the Z1 side of the head chip 110 in the third direction Z, the cover 200 may be positioned between the recording sheet S and at least one of the piezoelectric actuator 13 and the driving circuit 112 in the third direction Z. In the embodiment, as illustrated in FIG. 4, the cover 200 is fixed to the surface on the Z1 side of the head chip 110 provided in each of the head main bodies 100. Specifically, the cover 200 is fixed to the surface on the Z1 side of the compliance substrate 45. Therefore, the cover 200 of the embodiment is provided between the piezoelectric actuator 13 and the driving circuit 112 and the recording sheet S. In this manner, by providing the cover 200 between the piezoelectric actuator 13 and the driving circuit 112 of the head chip 110 and the recording sheet S, the cover 200 functions as a shield that protects the piezoelectric actuator 13 and the driving circuit 112 of the head chip 110 from static electricity or noise from the recording sheet S side. In other words, in the embodiment, the cover 200 is a shield of the head chip 110.

In addition, as illustrated in FIG. 4, in the embodiment, one cover 200 is provided commonly to a plurality of head chips 110 that configures one head main body 100. It is needless to say that the cover 200 is not limited to a configuration of being provided commonly to all of the head chips 110 provided in one head main body 100, and one cover 200 may be provided independently for each head chip 110, or may be provided independently for each group configured with two or more plural head chips 110. However, similar to the embodiment, by providing the cover 200 commonly to all of the head chips 110 that configure one head main body 100 and fixing the head chip 110 to the cover 200, it is possible to use the cover 200 when positioning the nozzle openings of the plurality of head chips 110 relatively, and to perform positioning a nozzle surfaces of the plurality of head chips 110 in the third direction Z with high accuracy.

In addition, as illustrated in FIG. 6, in the embodiment, the cover 200 is provided on the nozzle surface 20*a* side of the head main body 100 independently for each head main body 100, that is, without being continuous with the plurality of head main bodies 100. It is needless to say that the cover 200 may be provided continuously for each group of head main bodies 100 configured with a plurality of head main bodies 100. However, when the cover 200 is provided continuously for each group of the head main bodies 100, the number of configuration elements when the group of the head main bodies 100 and the cover 200 are unitized increases, there is a concern that the yield deteriorates. In addition, both the positioning of the head chips 110 with each other and the relative positioning of the head main bodies 100 with each other must be performed when forming the head chips 110 into a unit, and there is a concern that positioning work becomes complicate. In the embodiment, by providing the cover 200 for each of the head main bodies 100, it is possible to improve the yield, to perform the positioning the head chips 110 with each other and the positioning of the head main bodies 100 with each other, and to simplify the positioning work.

Specifically, as illustrated in FIG. 3, the cover 200 includes a base portion 201, a first extending portion 202, and a second extending portion 203.

The base portion 201 is configured with a plate-shaped member provided on the nozzle surface 20*a* side, and is joined to the surface on the Z1 side of the holding member 120 in the third direction Z, that is, the end surface on the Z1 side of the foot portion 128 by the adhesive (not illustrated). The Z1 side of the holding portion 127 of the holding member 120 is covered with the base portion 201 as described above.

In addition, as illustrated in FIGS. 4 and 6, the base portion 201 is provided with an exposure opening portion 204 for opening the nozzle opening 21 of each of the head chips 110. In the embodiment, the exposure opening portion 204 is provided so as to be open independently for each of the head chips 110. In other words, since the head main body 100 of the embodiment has six head chips 110, six independent exposure opening portions 204 are provided in the base portion 201. It is needless to say that, depending on the configuration or the like of the head chip 110, one common exposure opening portion 204 may be provided for a group configured with a plurality of head chips 110.

In addition, the exposure opening portion 204 is provided so as to open along the fourth direction Xa which is the arrangement direction of the nozzle openings 21. In other words, when viewed in a plan view from the third direction Z, the exposure opening portion 204 has a parallelogram in which both side surfaces in the second direction Y are provided in the direction along the fourth direction Xa. In addition, in the embodiment, the exposure opening portion 204 has an opening slightly greater than the nozzle plate 20, and the cover 200 is joined to the compliance substrate 45 of each of the head chips 110 via an adhesive (not illustrated). Therefore, the periphery of the nozzle plate 20 of the head chip 110 is covered with the cover 200. Therefore, it is possible to suppress deformation or destruction caused by the recording sheet S that abuts against the head chip 110, by the cover 200. In other words, the cover 200 also functions as a protective member for protecting the head chip 110 and the nozzle surface 20*a* side of the head main body 100. In addition, by fixing each of the head chips 110 to the common cover 200, it is possible to fix the nozzle openings of each of the head chips 110 to the cover 200 by relatively positioning the nozzle openings, to align the positions of the nozzle surfaces 20*a* of the plurality of head chips 110 in the third direction Z, and to improve printing accuracy by allowing the ink droplets to land with high accuracy.

As illustrated in FIGS. 3 and 7, the first extending portion 202 extends from both of the end portions in the second direction Y of the base portion 201 toward the Z2 side, and is configured with a plate-like member having a size that covers the opening of the holding portion 127 in the second direction Y. In the embodiment, the first extending portion 202 is provided along the third direction Z. The first extending portion 202 adheres to the side surface of the foot portion 128 in the second direction Y by an adhesive 140. Accordingly, the inside of the holding portion 127 which is the space between the holder 122 that holds the head chip 110 and the cover 200, is sealed, and it is possible to suppress intrusion of moisture, such as ink, into the holding portion 127. In addition, by making the first extending portion 202 and the holder 122 adhere to each other, a foot portion for adhering to the base portion 201 of the cover 200 becomes unnecessary on both sides in the second direction Y of the holder 122. Therefore, when the head main body 100 is arranged in parallel in the second direction Y, the foot portion does not exist between the head main bodies 100 adjacent to each other, and thus, it is possible to narrow the distance between the adjacent head main bodies 100 in the second direction Y. Accordingly, it is possible to provide the head chips 110 of the head main bodies 100 that are adjacent in the second direction Y to be close to each other. In addition, in the embodiment, a recess portion 129 is provided on the side surface of the holder 122 in the second direction Y, and the first extending portion 202 adheres to the inside the recess portion 129. Therefore, the amount of projection of the first extending portion 202 in the second direction Y is reduced, and the interval between the head main bodies 100 adjacent to each other in the second direction Y can be further narrowed.

As illustrated in FIGS. 3 and 8, the second extending portion 203 is a plate-like member which extends from both of the end portions of the base portion 201 in the first direction X toward the Z2 side. The second extending portion 203 is provided to be inclined in a direction of being separated from the holding member 120 on the Z2 side, compared with the Z1 side on the base portion 201 side in the third direction Z. In other words, the second extending portion 203 is provided not to extend perpendicularly to the base portion 201 such that the width of the two second extending portions 203 that oppose each other in the second direction Y widens to the side opposite to the base portion 201 compared to the width on the base portion 201 side. Accordingly, a void is formed between the second extending portion 203 and the side surface of the holding member 120 in the first direction X.

In the cover 200, a surface which faces the recording sheet S, that is, at least a surface on the Z1 side of the base portion 201 is a liquid repellent surface 205. In the embodiment, by providing a liquid repellent film (not illustrated) over the surface of the base portion 201, the first extending portion 202, and the second extending portion 203 on the side opposite to the head main body 100, the liquid repellent surface 205 is achieved. In addition, the liquid repellent surface 205 refers to a material having liquid repellency to the ink than a base material of the cover 200. The liquid repellent film used as the liquid repellent surface 205 is not particularly limited as long as the liquid repellent film has liquid repellency to the ink, and for example, a metal film containing a fluorine-based polymer, a molecular film of an alkoxide having liquid repellency, or the like, can be used. In this manner, by setting at least a surface on which the cover 200 which faces the recording sheet S in the cover 200, that is, by setting the surface on the surface on the Z1 side of the base portion 201 as the liquid repellent surface 205, it is possible control adhesion of ink to the cover 200. In addition, by not providing the liquid repellent film on the surface side of the cover 200 to which the head main body 100 is joined, it is possible to reliably join the cover 200 and the head main body 100 to each other. Furthermore, by not providing the liquid repellent film on the surface of the cover 200 on the head main body 100 side, specifically, by allowing the second conduction portion 210 which will be described in detail later to abut against the surface on the head main body 100 side on which the liquid repellent film of the cover 200 is not provided, it is possible to reliably conduct the second conduction portion 210 and the cover 200 to each other. In other words, in a case of using a molecular film of a metal alkoxide as the liquid repellent film, when the liquid repellent film is provided on the surface of the cover 200 on the head main body 100 side, it becomes difficult to conduct the second conduction portion 210 and the cover 200 to each other. In other words, in a case of using a metal film containing a fluorine-based polymer as the liquid repellent film, even when the liquid repellent film is provided on the head main body 100 side of the cover 200, only by bringing the second conduction portion 210 and the liquid repellent film into contact with each other, the conduction is possible, and thus, it is possible to achieve the conduction between the second conduction portion 210 and the cover 200 to each other.

As illustrated in FIGS. 5 to 8, in the embodiment, the base 300 is made of a material having conductivity, such as metal. By manufacturing the base 300, for example, by aluminum die casting, it is possible to manufacture the base 300 at low cost and with high accuracy. It is needless to say that the base 300 is not limited to a material having conductivity, and may be formed of a material, such as resin.

The base 300 holds a plurality of head main bodies 100, and as illustrated in FIGS. 6 and 7, a wall portion 302 in which an accommodation portion 301 which is a space that opens toward the Z1 side is provided, is provided. A part of the plurality of head main bodies 100 on the Z2 side is accommodated in the accommodation portion 301 of the base 300. In the embodiment, the nozzle surface 20*a* side of the head main body 100 protrudes toward the Z1 side from the wall portion 302 and is accommodated in the accommodation portion 301. In other words, the base 300 is disposed to be separated from the plurality of covers 200, nipping at least one of the driving circuit 112 which is a switching element provided in the head main body 100 with the cover 200 and a piezoelectric actuator 13 which is a pressure generating element. In the embodiment, since both of the driving circuit 112 and the piezoelectric actuator 13 are contained on the inside of the head main body 100, between the plurality of covers 200 and the base 300 disposed to be separated from each other, both of the driving circuit 112 and the piezoelectric actuator 13 are nipped.

In addition, the accommodation portion 301 of the embodiment has a size capable of accommodating a plurality of head main bodies 100, and in this embodiment, six head main bodies 100, in one accommodation portion 301. In addition, the accommodation portion 301 has a size to the extent that the wall portion 302 does not abut against the side surface of the head main body 100 when accommodating the plurality of head main bodies 100.

In addition, as illustrated in FIG. 6, when viewed in a plan view from the nozzle surface 20*a* side in the third direction Z, shapes on both sides in the second direction Y which is the arrangement direction of the head main bodies 100, are shapes in the fourth direction Xa. In other words, the side surfaces on the Z1 side of the head main body 100 on both sides in the second direction Y are provided to be inclined in the same direction as the fourth direction Xa which is the arrangement direction of the nozzle openings 21. In addition, the plurality of head main bodies 100 are arranged in parallel along a straight line in a second direction Y orthogonal to the first direction X which is the transport direction, and are fixed in the accommodation portion 301 of the base 300. In this manner, by setting side surfaces on both sides in the arrangement direction of the head main body 100 to have a direction the same as the fourth direction Xa which is the arrangement direction of the nozzle opening 21, even when the plurality of head main bodies 100 are disposed along the straight line in the second direction Y, it is possible to dispose at least a part of the nozzle opening 21 of the head main bodies 100 adjacent to each other in the second direction Y, at positions overlapping the first direction X. Therefore, it is possible to form the nozzle openings 21 arranged in parallel at the same interval in the second direction Y of the recording head 3. In addition, by disposing the plurality of head main bodies 100 along the straight line in the second direction Y, it is possible to reduce the width of the recording head 3 in the first direction X, and to reduce the size of the recording head 3. In other words, in the embodiment, since the plurality of head main bodies 100 are not disposed in the first direction X, it is possible to reduce the size in the first direction X. It is needless to say that the head main body 100 arranged in parallel in the second direction Y may be disposed to be shifted in the first direction X. However, when the head main body 100 is largely shifted in the first direction X, the width of the base 300 or the like in the first direction X is wider than that in the embodiment. When the size of the recording head 3 in the first direction X is increased in this manner, the distance in the first direction X between the two pressing rollers 67 in the ink jet type recording apparatus 1 is increased, and there is a concern that it is difficult to fix the posture of the recording sheet S. In addition, there is a concern that the size of the recording head 3 and the ink jet type recording apparatus 1 increases.

In addition, the shape of the head main body 100 when viewed in a plan view from the nozzle surface 20*a* side is not limited to a substantially parallelogram shape, but may be a rectangular shape, a trapezoidal shape, a polygonal shape, or the like. In addition, in the embodiment, the six head main bodies 100 are fixed to the base 300, but the number of the head main bodies 100 is not particularly limited, and may be one or plural, for example, two or more.

In addition, in the embodiment, the plurality of head main bodies 100 are arranged in parallel in the second direction Y with spaces being provided between the head main bodies 100 adjacent to each other. In other words, the head main bodies 100 adjacent to each other are disposed with voids therebetween without the surfaces in the second direction Y abutting against each other. By providing a space between the head main bodies 100 arranged in parallel in the second direction Y in this manner, it is possible to relatively position the nozzle openings 21 of the plurality of head main bodies 100. In addition, spaces are also provided between the plurality of head main bodies 100 and the wall portion 302 which forms the accommodation portion 301 for accommodating the plurality of head main bodies 100 therein. By providing a space between the head main bodies 100 and the wall portion 302, it is possible to relatively position the nozzle openings 21 of the plurality of head main bodies 100 in the accommodation portion 301.

In addition, in the embodiment, one accommodation portion 301 which accommodates the plurality of head main bodies 100 is provided, however, not being limited thereto, the accommodation portion 301 may be provided independently for one head main body 100 or two or more head main bodies 100. However, in a case where the accommodation portion 301 is divided, the wall portion 302 is provided between the head main bodies 100 adjacent to each other in the second direction Y, the space between the adjacent head main bodies 100 is increased, the size of the recording head 3 increases in the second direction Y, and it becomes difficult to dispose the nozzle openings 21 of the adjacent head main bodies 100 at the same position in the first direction X. In the embodiment, by accommodating the plurality of head main bodies 100 in one accommodation portion 301, it is possible to dispose the head main bodies 100 at a high density, to reduce the size of the recording head 3 in the second direction Y, and to easily dispose the nozzle openings 21 of the adjacent head main bodies 100 at the same position in the first direction X.

In addition, in the embodiment, the head main body 100 is fixed to the base 300 via a spacer 101, as illustrated in FIGS. 5 and 7. The spacer 101 is fastened to the surface on the Z2 side of the head main body 100 by a second head main body screw member 602. In addition, the spacer 101 is fastened to the surface on the Z1 side of the base 300 by a third head main body screw member 603. Accordingly, the head main body 100 is fixed to the base 300 via the spacer 101. In addition, by fixing the spacer 101 fixed to the head main body 100 by the second head main body screw member 602 with the third head main body screw member 603 to the base 300, it is possible to easily attach and detach the head main body 100 to and from the base 300. Incidentally, the fixing of the spacer 101 and the head main body 100 is not limited to fixing by the second head main body screw member 602, but may be fixed by adhesion with an adhesive. In addition, the spacer 101 may be provided integrally with a part of the head main body 100.

In addition, a supply hole 303 which penetrates in the third direction Z is provided on the base 300. The flow path of the head main body 100 fixed to the base 300 is exposed to the surface on the Z2 side by the supply hole 303, and the distribution flow path member 400 is connected to the flow path exposed by the supply hole 303.

In addition, as illustrated in FIGS. 5 and 8, a first cable opening portion 304 for inserting the first cable 126 of the head main body 100 is provided on the base 300. In the embodiment, the first cable opening portion 304 is provided one by one on both sides in the first direction X for each of the head main bodies 100. In other words, a total of two first cable opening portions 304 are provided for each of the head main bodies 100. The first cable 126 of the head main body 100 fixed in the accommodation portion 301 of the base 300 via the first cable opening portion 304 is led out to the outside of the accommodation portion 301, that is, the Z2 side of the base 300.

In addition, a step 305 which is open toward the Z2 side is provided at the outer circumference of each of the wall portions 302 on both sides in the first direction X in the wall portion 302, and relay boards 310 are accommodated in each of the steps 305. In other words, the end surface on the Z1 side which is the nozzle surface 20*a* side of the relay board 310, is covered with the wall portion 302. A plurality of first cables 126 led out toward the Z2 side from the first cable opening portion 304 are electrically connected to the relay board 310. In the embodiment, the relay board 310 has a length extending across the plurality of head main bodies 100 in the second direction Y, in the embodiment, six head main bodies 100. In addition, the two relay boards 310 are arranged in parallel in the second direction Y in the in-plane direction of the nozzle surface 20*a*.

In this manner, by connecting the first cable 126 of the plurality of head main bodies 100 to the common relay board 310 by inserting the first cable opening portion 304 which is open to the Z2 side of the base 300, it is possible to make intrusion ink mist on the nozzle surface 20*a* side from the first cable opening portion 304 difficult, and it is possible to suppress the adhesion of ink to the first cable 126 or the second wiring substrate 123 of the head main body 100.

In addition, the relay board 310 has a connector 311, and a control cable 7*a* from a controller 7 fixed to the apparatus main body 2 is attachably and detachably connected to the connector 311. In the embodiment, one control cable 7*a* is connected to each of the relay boards 310. It is needless to say that the number of control cables 7*a* is not limited, and may be two or more. Furthermore, although not specifically illustrated, a wiring (ground pattern) connected to the ground is provided on the relay board 310, and the ground pattern of the relay board 310 is connected to the ground via the controller 7. In addition, although the ground pattern of the relay board 310 is connected to the signal ground in the controller 7, the ground pattern is not particularly limited thereto, and it may be connected to the frame ground or the ground. In other words, a case where the ground pattern of the relay board 310 is connected to the ground means that the ground pattern is connected to any one of the signal ground, the frame ground, and the ground. In addition, although not specifically illustrated, a control IC may be mounted on the relay board 310.

In addition, the relay board 310 is fixed to the wall portion 302 of the base 300 by a first screw member 611. Between the relay board 310 and the wall portion 302, a first insulating member 320 configured of an insulating sheet or the like having insulation is provided. In addition, between the relay board 310 and the first screw member 611, a second insulating member 321 configured of an insulating washer or the like having insulation is provided. By providing the first insulating member 320 and the second insulating member 321, the ground pattern of the relay board 310 is fixed by the first screw member 611 without conducting to the base 300 having conductivity. In addition, in the embodiment, the first insulating member 320 is provided between the relay board 310 and the wall portion 302, and the second insulating member 321 is provided between the relay board 310 and the first screw member 611, but the invention is not particularly limited thereto, and as long as a part that abuts against at least the wall portion 302 of the relay board 310 and a part which abuts against the first screw member 611 are formed of an insulating material, the relay board 310 may be fixed directly to the wall portion 302 via the first screw member 611 without providing the first insulating member 320 and the second insulating member 321.

As illustrated in FIGS. 5 and 8, a distribution flow path member 400 is provided on the surface on the Z2 side of the base 300 as described above.

The distribution flow path member 400 distributes and supplies the ink supplied from the storage unit 4 to each of the head main bodies 100, and the supply pipe 4*a* (refer to FIG. 1) connected to the storage unit 4 is attachably and detachably connected. In addition, at least one of the tip end of the supply pipe 4*a* and the distribution flow path member 400 is provided with a connector (not shown) that can be easily attached to and detached from the other one. Therefore, the supply pipe 4*a* is provided attachably and detachably to and from the distribution flow path member 400 via the connector. On the inside (not illustrated) of the distribution flow path member 400, there is provided a distribution flow path for distributing and supplying the ink supplied for each color or different type supplied from the supply pipe 4*a* to the head main body 100.

As illustrated in FIGS. 5, 7, and 8, the base cover 500 is a box-shaped member that is provided on the Z2 side of the base 300 and covers the distribution flow path member 400 and the relay board 310 on the Z2 side of the base 300.

The base cover 500 is provided with a control cable opening portion 501 for inserting the control cable 7*a*, and the control cable 7*a* is inserted into the control cable opening portion 501 and connected to the internal relay board 310.

In addition, a supply pipe opening portion 502 for inserting the supply pipe 4*a* is provided in the base cover 500, and the supply pipe 4*a* inserted into the supply pipe opening portion 502 is connected to the distribution flow path member 400.

In the embodiment, the base cover 500 is made of a material having conductivity, such as metal. In addition, the base cover 500 is fixed to the wall portion 302 of the base 300 by a second screw member 612. The second screw member 612 is formed of a material having conductivity, such as metal. Therefore, the base cover 500 is conducted to the base 300 by being in direct contact therewith, and also conducts via the second screw member 612.

In other words, the relay board 310 held between the base 300 and the base cover 500 is surrounded by the base 300 and the base cover 500 which have conductivity and are conducted to each other. In other words, the base 300 and the base cover 500 function as a shield that suppresses radiation of noise from the relay board 310 to the outside and suppresses influence of noise from the outside on the relay board 310.

In addition, as illustrated in FIG. 8, a first conduction portion 510 is provided between the base cover 500 and the apparatus main body 2 that supports the recording head 3. In the embodiment, the first conduction portion 510 is provided on each side of the base cover 500 in the first direction X. The first conduction portion 510 is made of a compression coil spring formed of a material having conductivity, such as metal, is inserted in a compressed state between the base cover 500 and the apparatus main body 2, and is held by an elastic force of the spring. It is needless to say that the first conduction portion 510 may be fixed to at least one of the apparatus main body 2 and the base cover 500. It is preferable that the first conduction portion 510 be fixed to only one of the apparatus main body 2 and the base cover 500. Accordingly, it is possible to suppress falling of the first conduction portion 510 at an unexpected timing, and to position the recording head 3 with respect to the apparatus main body 2. In addition, by fixing the first conduction portion 510 to only one of the apparatus main body 2 and the base cover 500, it is possible to easily attach and detach the recording head 3 to and from the apparatus main body 2, and thus, it is possible to easily perform maintenance, such as exchange or replacement and cleaning of the recording head 3.

In addition, in the embodiment, a coil spring is exemplified as the first conduction portion 510, but the invention is not limited thereto, and may be another biasing member, such as a plate spring, or may be a porous metal material or a conductive wire. In addition, as the first conduction portion 510, solder or a conductive adhesive may be used. Furthermore, by allowing the base covers 500 or the base 300 to directly abut against the apparatus main body 2 without providing the first conduction portion 510, both of the base covers 500 and the base 300 may be conducted to each other. In a case where the base cover 500 or the base 300 directly abuts against the apparatus main body 2, both of the base cover 500 and the base 300 may be fixed by screws or clips.

In this manner, by making the base cover 500 conductive to the apparatus main body 2 by the first conduction portion 510, the base 300 and the base cover 500 are connected to the apparatus main body 2 via the first conduction portion 510, that is, connected to a so-called frame ground.

In addition, as illustrated in FIGS. 6 and 8, the recording head 3 is provided with the second conduction portion 210 for conducting the base 300 and the cover 200 at a plurality of positions. In the embodiment, the second conduction portion 210 which abuts against and conducts to each of the second extending portions 203 provided on both sides in the first direction X of the cover 200, is provided.

Here, the second conduction portion 210 is configured of a spring-shaped plate member having conductivity, that is, a so-called plate spring. One end of the second conduction portion 210 is fixed to the surface on the Z1 side of the wall portion 302 of the base 300 by a third screw member 613, and the other end is a free end. In addition, the tip end which becomes a free end of the second conduction portion 210 is disposed on the back side of the second extending portion 203 of the cover 200, that is, on the surface of the second extending portion 203 on the holding member 120 side to abut against the center portion in the first direction X at a predetermined pressure. By the second conduction portion 210, the base 300 having conductivity and the cover 200 are conducted to each other. In other words, the cover 200 having conductivity is conducted to the base 300 having conductivity via the second conduction portion 210. In addition, since the base 300 is connected to the apparatus main body 2 via the base cover 500 and the first conduction portion 510, that is, connected to a so-called frame ground, one cover 200 is connected to the frame ground via a plurality of, in the embodiment, two second conduction portions 210. In other words, the cover 200 which is the shield of the head chip 110 is connected to the apparatus main body 2 (frame ground) by the second conduction portion 210, the base 300, the base cover 500, and the first conduction portion 510 which are conductive materials and are conducted to each other. Therefore, in the embodiment, the second conductive path which connects the cover 200 that is the shield of the head chip 110 to the ground includes the second conduction portion 210, the base 300, the base cover 500, and the first conduction portion 510.

In addition, in the embodiment, the cover 200 is connected to the ground via the second conduction portion 210, but the invention is not particularly limited thereto, and the second conduction portion 210 may be formed to be conducted to the apparatus main body 2 on either one of the base 300 and the base cover 500 or via other members, such as conductive wire, without passing through both of the base 300 and the base cover 500. In a case where the second conduction portion 210 is conducted to the apparatus main body 2 without passing through the base 300 and the base cover 500 as described above, the second conductive path includes the second conduction portion 210 and another member, such as a conductive wire.

In the embodiment, the second conduction portions 210 which are provided to conduct to each of the second extending portions 203 provided on both sides in the first direction X of the cover 200, are provided. In other words, two second conduction portions 210 are provided at positions nipping the piezoelectric actuator 13 which is a pressure generating element, or the driving circuit 112 having a switching element, in the first direction X. In other words, in the embodiment, the piezoelectric actuator 13 and the driving circuit 112 which are pressure generating elements, are positioned between the two second conduction portions 210 provided on both sides of one cover 200 in the first direction X.

In addition, the plurality of second conduction portions 210 provided for one cover 200 are positioned on the same side with respect to the cover 200. Here, a case where the plurality of second conduction portions 210 are positioned on the same side with respect to the cover 200 means that the plurality of second conduction portions 210 commonly comes into contact with only one of the surfaces of the cover 200. In other words, the plurality of second conduction portions 210 commonly comes into contact with the surface of the cover 200 on the head main body 100 side, or the surface opposite to the head main body 100. In the embodiment, since the two second conduction portions 210 provided for one cover 200 are commonly in contact with the surface of the cover 200 on the head main body 100 side, it can be said that the plurality of second conduction portions 210 provided for one cover 200 are positioned on the same side with respect to the cover 200. In this manner, as the plurality of second conduction portions 210 are positioned on the same side with respect to the cover 200, it is possible to suppress application of uneven pressure to the cover 200 by the pressure at which the second conduction portion 210 comes into contact with the cover 200, and to suppress deviation of the nozzle opening 21 due to positional deviation between the cover 200 and the head main body 100. In other words, in the two second conduction portions 210, in a case where one of the second conduction portions 210 abuts against the side opposite to the head main body 100 of one second extending portion 203, and the other second conduction portion 210 abuts against the head main body 100 side of the other second extending portion 203, a stress is applied to the cover 200 in the same direction as the first direction X by the contact pressure of the two second conduction portions 210, the cover 200 and the head main body 100 are likely to be deviated in the first direction X, and the position deviation of the nozzle opening 21 is likely to be generated.

In addition, in the embodiment, the second conduction portion 210 conducts by abutting against the side opposite to the liquid repellent surface 205 of the second extending portion 203 of the cover 200. Therefore, even when an insulating material is used as the liquid repellent film that forms the liquid repellent surface 205, the second conduction portion 210 can conduct to the cover 200. Therefore, the material of the liquid repellent film that forms the liquid repellent surface 205 is not limited, and a material having high liquid repellency as the liquid repellent surface 205, for example, a molecular film of a metal alkoxide or the like can be used. It is needless to say that the second conduction portion 210 may conduct to the cover 200 by abutting against the side opposite to the head main body 100 of the second extending portion 203 of the cover 200. In this case, for example, the liquid repellent film may not be provided only at a part against which at least the second conduction portion 210 of the second extending portion 203 abuts.

In addition, by connecting the cover 200 to the ground via the plurality of second conduction portions 210, in the embodiment, the two second conduction portions 210, it is possible to suppress generation of noise due to connection failure of the cover 200 to the ground, that is, so-called ground failure. In other words, when the connection of the cover 200 to the ground is insufficient, the cover 200 acts similar to a flat antenna, and the noise generated from the piezoelectric actuator 13 which is a pressure generating element and the driving circuit 112 having a switching element, is radiated to the outer space by the cover 200. In particular, similar to the embodiment, in a case where the cover 200 has a relatively large area as being commonly provided in the plurality of head chips 110, the cover 200 is provided commonly to the plurality of head chips 110, the grounding is likely to become insufficient only by grounding the cover 200 by one single second conduction portion 210, and the cover 200 is likely to work similar to an antenna. In addition, similar to the embodiment, in a case where the plurality of covers 200 are disposed to be aligned in the second direction Y, amplification and directivity occurs in the second direction Y in which the covers 200 are aligned and deteriorates. In the embodiment, by connecting the cover 200 to the ground by the plurality of second conduction portions 210, it is possible to sufficiently connect the cover 200 having a relatively large area to the ground, to suppress operation of the cover 200 similar to an antenna, and to suppress the generation of the amplification and directivity by the cover 200 even when the covers 200 are aligned.

In addition, in the embodiment, in the sectional direction illustrated in FIG. 8, members which surround the head chip 110, that is, the cover 200, the second conduction portion 210, and the base cover 500 are formed of a conductive material and are provided to conduct to each other. In other words, in the direction including the first direction X and the third direction Z, the recording head 3 is surrounded by a member which surrounds at least one of the piezoelectric actuator 13 that is a pressure generating element provided in the head chip 110 and the driving circuit 112 having a switching element and is conductive continuously across the circumferential direction. Therefore, the piezoelectric actuator 13 which is a pressure generating element provided on the head chip 110 and the driving circuit 112 having a switching element can suppress influence of static electricity or noise from the outside by members which surround the head chip 110 and conduct to each other, that is, the cover 200, the second conduction portion 210, the base 300, and the base cover 500, and to suppress radiation of noise generated from the piezoelectric actuator 13 and the driving circuit 112 to the outside. In other words, in the embodiment, the second conduction portion 210, the base 300, and the base cover 500 also function as a shield for protecting the piezoelectric actuator 13 and the driving circuit 112 of the head chip 110. In other words, in the embodiment, the shield of the head chip 110 includes the cover 200, the second conduction portion 210, the base 300, and the base cover 500. Incidentally, the second conduction portion 210, the base 300, and the base cover 500 also function as a second conductive path for connecting the cover 200 to the ground as described above. Therefore, the second conduction portion 210, the base 300, and the base cover 500 function as a shield for protecting the head chip 110 and function as a second conductive path.

In addition, in the embodiment, in the recording head 3, the cover 200, the second conduction portion 210, the base 300, and the base cover 500 which form the outer circumference in the direction including the first direction X and the third direction Z, are connected to the ground while conducting to each other across the circumferential direction, but in the second direction Y, an enclosure by the conductive member may be continuous. In other words, since the second conduction portion 210 of the embodiment is provided for each cover 200, the enclosure by conductive members is not continuous between the second conduction portions 210 arranged in parallel in the second direction Y. In this manner, even when the enclosure made by conductive members between the second conduction portions 210 is not continuous, it is possible to suppress influence of noise from the outside on the pressure generating element or the switching element, and the noise from the inside of the recording head 3 is unlikely to be radiated to the outside. In addition, in a case where the interval between the second conduction portions 210 arranged in parallel in the second direction Y is wide and the inside is influenced by noise and noise is radiated to the outside, by increasing the number of second conduction portions 210 arranged in parallel in the second direction Y, the interval may be narrow. For example, it is preferable that the enclosure made of a member that conducts to each other be performed at three or more positions in each of the both end portions and the center portion in the first direction X of the recording head 3, and more preferably, in the first direction X, the interval is equal to or less than the width of one head main body 100.

It is needless to say that the number of the second conduction portions 210 is not particularly limited, and may be one second conduction portion 210 for one cover 200, or may be three or more. For example, the second conduction portion 210 may be provided so as to be in contact with both of the end portions of the second extending portion 203 in the first direction X. In other words, in a plan view from the third direction Z with respect to one cover 200, the total of four second conduction portions 210 may be provided at positions that correspond to each of four corner portions of the base portion 201. Accordingly, it is possible to more reliably suppress the function of the cover 200 as an antenna.

In addition, in the embodiment, the foot portions 128 are provided on both sides of the holding member 120 in the first direction X, however, the foot portion 128 may not be provided.

Here, an electrical configuration of the ink jet type recording apparatus 1 of the embodiment will be described with reference to FIG. 9. In addition, FIG. 9 is a block diagram illustrating the electrical configuration of the ink jet type recording apparatus.

Figure 9:
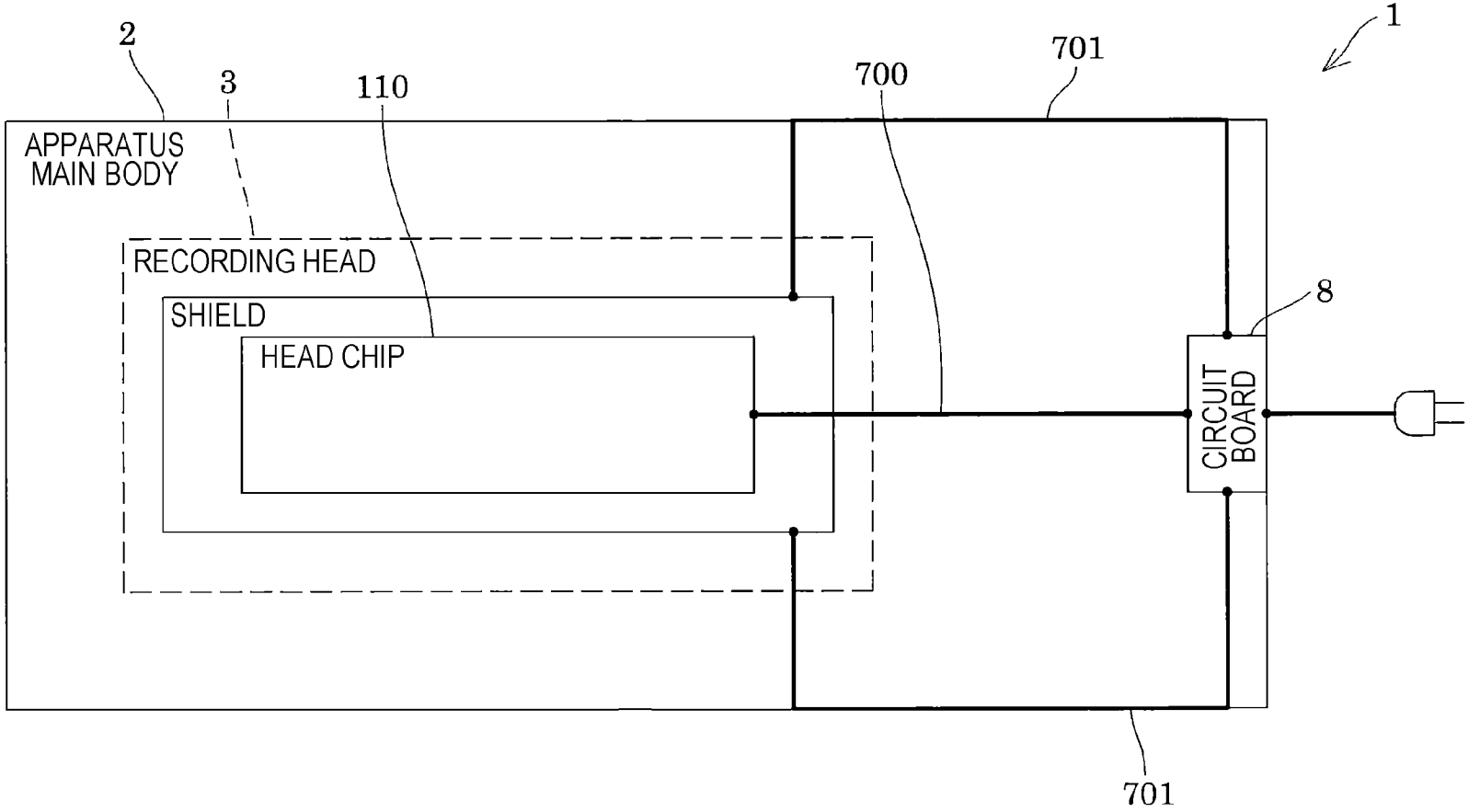
FIG. 9 is a view illustrating an electrical configuration of the recording apparatus according to Embodiment 1.

As illustrated in FIG. 9, the ink jet type recording apparatus 1 includes a circuit board 8. The circuit board 8 may be formed with a control circuit for controlling the entire ink jet type recording apparatus 1, or may be formed with a power supply circuit to which a current is supplied from a commercial power supply. In addition, the circuit board 8 may have both the control circuit and the power supply circuit. In addition, the power supply circuit is a circuit that converts a current fed from an outlet plug that is plugged into an outlet plug of a commercial power supply to a desired current. In the embodiment, the circuit board 8 includes both of the control circuit and the power supply circuit. In addition, the circuit board 8 generates a ground (signal ground) which is a reference potential from the power supply fed from the commercial power supply.

The driving circuit 112 connected to the piezoelectric actuator 13 of the head chip 110 is connected to the ground of the circuit board 8 provided on the outside of the recording head 3 via the first cable 126, the relay board 310 and the control cable 7*a*. In other words, in the embodiment, the first cable 126, the relay board 310, and the control cable 7*a* configure the first conductive path 700 that connects the head chip 110 to the ground on the outside of the recording head 3.

Meanwhile, the shield including at least the cover 200 for shielding the head chip 110, in the embodiment, the shield including the cover 200, the second conduction portion 210, the base 300, and the base cover 500 which are conducted to each other is connected to the ground (frame ground) by being connected to the apparatus main body 2 provided on the outside of the recording head 3 via the second conduction portion 210, the base 300, the base cover 500, and the first conduction portion 510. In other words, in the embodiment, the second conduction portion 210, the base 300, and the base cover 500 configure a second conductive path 701 that connects the shield to the ground on the outside of the recording head 3. In addition, since the second conductive path 701 is for connecting the shield that protects the head chip 110 to the ground, it is preferable that the second conductive path 701 be connected to the frame ground or the earth (ground) connected to the earth. According to this, it is possible to reliably protect the head chip 110 by the shield from the external noise or static electricity, and to suppress radiation of noise from the head chip 110 to the outside.

The first conductive path 700 and the second conductive path 701 are provided so as not to be conducted to each other on the inside of the recording head 3. In other words, as described above, when the relay board 310 is fixed to the base 300 with the first screw member 611, by providing the first insulating member 320 between the relay board 310 and the first screw member 611 and by providing the second insulating member 321 is provided between the relay board 310 and the base 300, the relay board 310 and the base 300 are in an electrically isolated state. Therefore, the piezoelectric actuator 13 and the driving circuit 112 of the head chip 110, the first conductive path 700 for connecting the piezoelectric actuator 13 and the driving circuit 112 to the ground, and the second conductive path 701 for connecting the shield and the shield of the head chip 110 to the ground, are not conducted to each other on the inside of the recording head 3. Therefore, it is possible to suppress transmission of the noise from the shield or the static electricity to the piezoelectric actuator 13 and the driving circuit 112 of the head chip 110 via the second conductive path 701 and the first conductive path 700, and to suppress malfunction or failure of the piezoelectric actuator 13 and the driving circuit 112 due to the noise or static electricity. Incidentally, when the first conductive path 700 which connects the head chip 110 and the head chip 110 to the ground, and the second conductive path 701 which connects the shield and the shield of the head chip 110 to the ground, are conducted on the inside of the recording head 3, there is a concern that static electricity or noise from the outside is transmitted to the head chip 110 via the shield and the piezoelectric actuator 13 or the driving circuit 112 of the head chip 110 is destroyed.

In addition, the frame ground connected to the apparatus main body 2 and the signal ground which is the reference potential generated from the power supply may be connected or may not be connected on the outside of the recording head 3, that is, on the circuit board 8. In other words, the first conductive path 700 and the second conductive path 701 may be conducted on the outside of the recording head 3. This is because, when the connection distance between the first conductive path 700 and the second conductive path 701 is long, the influence of noise and static electricity from the shield is less likely to be transmitted to the head chip 110. Incidentally, in a case of conducting the first conductive path 700 and the second conductive path 701 on the outside of the recording head 3, for example, it is preferable that the first conductive path 700 and the second conductive path 701 be connected to the earth by an earth rod or an earth plate, that is, so-called earth (grounding). In this manner, even when the first conductive path 700 and the second conductive path 701 are connected to the common ground, noise or static electricity are unlikely to be transmitted from the shield to the driving circuit 112 and the piezoelectric actuator 13 via the earth, and it is possible to suppress malfunction or destruction of the driving circuit 112 or the piezoelectric actuator 13.

Figure 10:
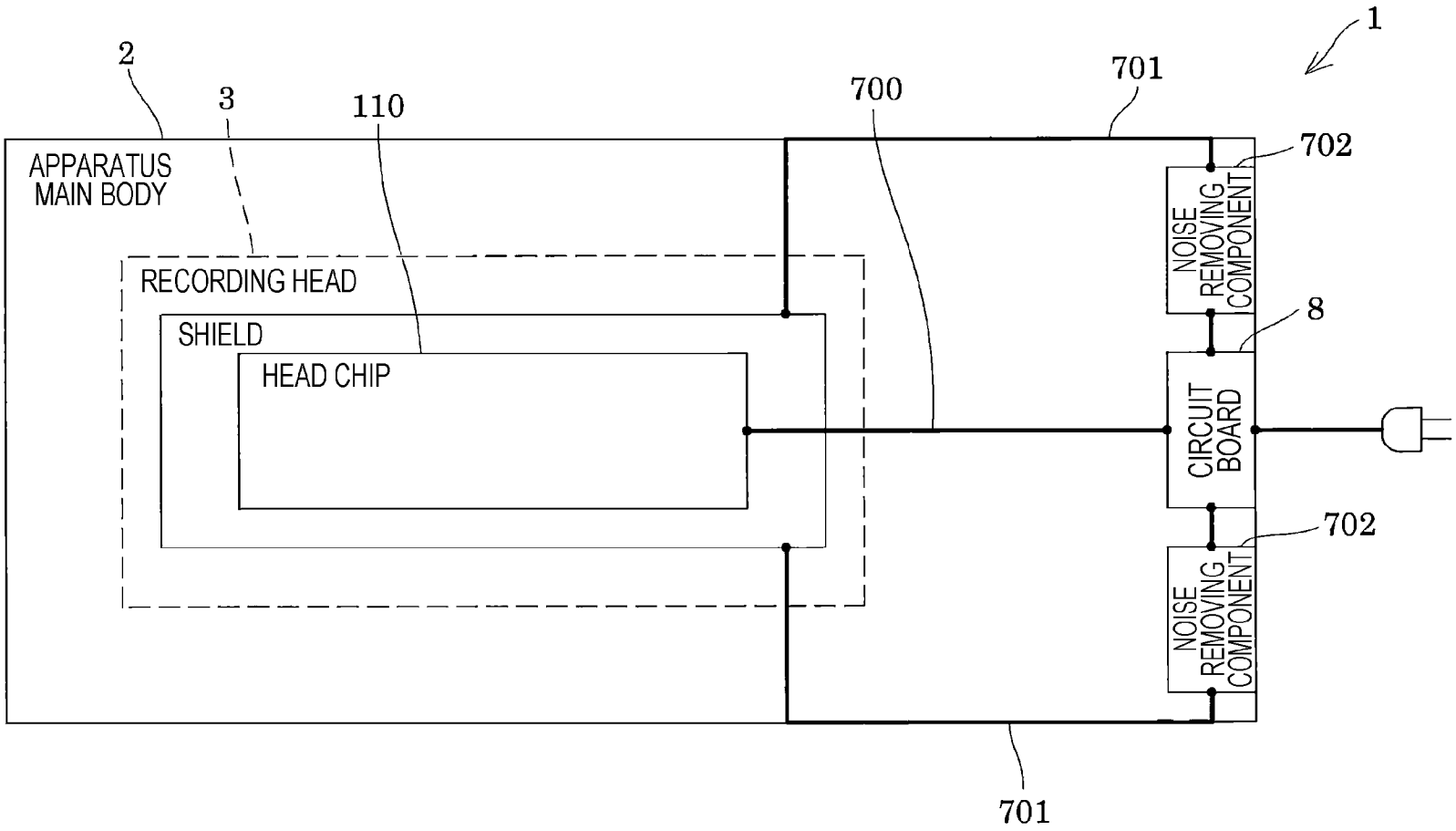
FIG. 10 is a view illustrating a modification example of an electrical configuration of the recording apparatus according to Embodiment 1.

In addition, in a case where the first conductive path 700 and the second conductive path 701 are connected to the common ground on the outside of the recording head 3, for example, a noise removing component may be provided between the first conductive path 700 and the second conductive path 701. In other words, the first conductive path 700 and the second conductive path 701 may be conducted to each other via the noise removing component. Specifically, as illustrated in FIG. 10, a noise removing component 702 may be provided at a part that connects the second conductive path 701 and the ground of the circuit board 8 to each other. In addition, as the noise removing component, for example, it is possible to use a single element, such as a Zener diode, a chip varistor, a damping resistance, or a ferrite core, or a combination thereof. In this manner, by connecting the first conductive path 700 and the second conductive path 701 via the noise removing component 702 on the outside of the recording head 3, it is possible to suppress transmission of noise or static electricity to the driving circuit 112 of the head chip 110 or the piezoelectric actuator 13 via the shield. It is needless to say that, even in a case where the first conductive path 700 and the second conductive path 701 are connected to the earth, the noise removing component may be provided between the first conductive path 700 or the second conductive path 701 and the earth.

As described above, the recording head 3 of the embodiment includes: the head chip 110 which ejects the ink which is a liquid based on an electric signal; the first conductive path 700 for connecting the head chip 110 to a ground on the outside of the recording head 3; and the second conductive path 701 for connecting the shield of the head chip 110 to the ground.

In this manner, by connecting the shield to the ground by the second conductive path 701, it is possible to suppress radiation of noise from the inside of the head chip 110 to the outside, and to protect the head chip 110 from the outside noise and static electricity. In addition, by providing the first conductive path 700 and the second conductive path 701 in the recording head 3, it is possible to prevent the first conductive path 700 and the second conductive path 701 from conducting to each other on the inside of the recording head 3, to suppress transmission of static electricity or noise from the shield to the pressure generating element or the switching element via the second conductive path 701 and the first conductive path 700, and to suppress malfunction and destruction of the pressure generating element or the switching element due to static electricity or noise.

In addition, the ground connected to the first conductive path 700 and the second conductive path 701 may be a frame ground connected to the apparatus main body 2 of the ink jet type recording apparatus 1, may be a signal ground which is a reference potential generated by the circuit board 8, or may be the earth (ground) connected to the earth. In addition, the ground to which the first conductive path 700 and the second conductive path 701 are connected may be the same ground or different grounds. It is needless to say that different grounds may be connected to each other. In either case, since the first conductive path 700 and the second conductive path 701 do not conduct to each other on the inside of the recording head 3, noise from the shield or static electricity are unlikely to be transmitted to the head chip 110 via the second conductive path 701 and the first conductive path 700, and it is possible to suppress the malfunctioning and destruction of the pressure generating element and the switching element of the head chip 110.

In addition, it is preferable that the shield be a conductive member formed of a conductive material provided between the head chip 110 and the recording sheet S which is a liquid ejecting medium on which the liquid ejected by the head chip 110 lands, that is, the cover 200 in the embodiment. In other words, the shield of the head chip 110 includes at least a conductive member provided between at least one of the piezoelectric actuator 13 which is the pressure generating element of the head chip 110 and the driving circuit 112 having the switching element that drives the pressure generating element, and the recording sheet S. Accordingly, it is possible to protect at least one of the pressure generating element and the switching element covered with the cover 200 from noise or static electricity from the recording sheet S side.

In addition, as described above, the shield may be provided so as to surround at least one of the pressure generating element and the switching element by members which are continuous to each other across the periphery in the sectional direction illustrated in FIG. 8 and are conducted to each other. In this manner, by providing the shield, it is possible to suppress radiation of noise emitted from the pressure generating element and the switching element to the outside, and protection from noise or static electricity from outside is possible. In the embodiment, since both the piezoelectric actuator 13 which is the pressure generating element and the driving circuit 112 having the switching element, are surrounded by the shield, it is possible to protect both of the piezoelectric actuator 13 and the driving circuit 112 from noise or static electricity from the outside.

In addition, in the embodiment, the first conductive path 700 and the second conductive path 701 are conducted to each other via the noise removing component 702. Accordingly, the static electricity or noise from the shield is unlikely to be transmitted to the head chip 110 via the second conductive path 701 and the first conductive path 700.

In addition, in the embodiment, the recording head 3 and the apparatus main body 2 which supports the recording head 3 are provided. In addition, the recording head 3 and the apparatus main body 2 are connected to each other via an attachable and detachable connector. In other words, in the recording head 3, the control cable 7*a* is attachably and detachably provided to the connector 311 of the relay board 310, and the supply pipe 4*a* is attachably and detachably provided in the distribution flow path member 400 by the connector (not illustrated). Therefore, it is possible to easily attach and detach the recording head 3 from the apparatus main body 2. In addition, after the recording head 3 is mounted, by connecting the control cable 7*a* to the connector 311, it is possible to easily connect the relay board 310 to the ground.

In addition, in the embodiment, the recording head 3 is provided so as to be movable relative to the apparatus main body 2. By allowing the recording head 3 to move relative to the apparatus main body 2 in the third direction Z, it is possible to respond to various types of recording sheets S. In addition, by making the recording head 3 relatively movable in the second direction Y with respect to the apparatus main body 2, it is possible to reduce the size of the recording head 3 and the apparatus main body 2.

In addition, in the embodiment, the ink jet type recording apparatus 1 includes the circuit board 8 having a ground. According to this, it is possible to connect at least one of the first conductive path 700 and the second conductive path 701 to the ground of the circuit board 8.

It is preferable that the first conductive path 700 be connected to the earth or connected to the ground by an outlet plug, and the second conductive path 701 be connected to the earth. According to this, it is possible to reliably protect the head chip 110 by the shield from the external noise or static electricity, and to suppress radiation of noise from the head chip 110 to the outside.

In addition, in the embodiment, the shield is a conductive member formed of a conductive material provided between the head chip 110 and the recording sheet S which is a liquid ejecting medium on which the liquid ejected by the head chip 110 lands, that is, the cover 200, and the cover 200 is connected to the ground by the second conductive path 701 having the plurality of second conduction portions 210.

In this manner, by connecting the cover 200 to the ground by the plurality of second conductive paths 701, it is possible to suppress operation of the cover 200 as an antenna, and to suppress radiation of noise from the inside of the recording head 3 to the outside by the cover 200, the cover 200 functions as a shield, and it is possible to suppress malfunction or destruction of the head chip 110 due to static electricity or noise from the outside. Incidentally, in the embodiment, since the cover 200 is positioned between the recording sheet S and the piezoelectric actuator 13 and the driving circuit 112, it is possible to protect both of the piezoelectric actuator 13 and the driving circuit 112 from noise or static electricity from the outside, however, the invention is not particularly limited thereto, and for example, only one of the piezoelectric actuator 13 and the driving circuit 112 may be provided on the side opposite to the recording sheet S of the cover 200.

Embodiment 2

Figure 11:
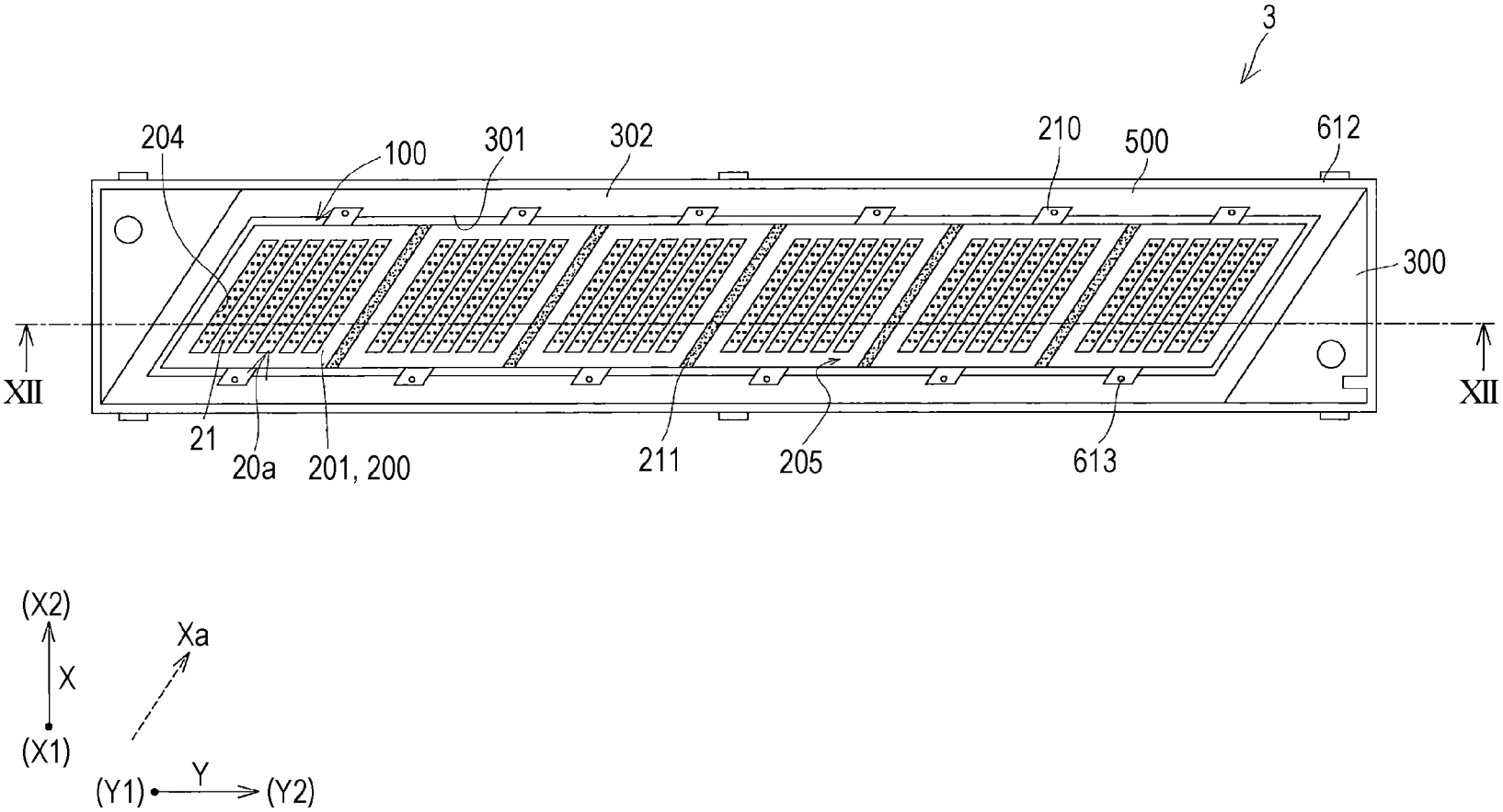
FIG. 11 is a sectional view of main portions of a recording head according to Embodiment 2.
Figure 12:
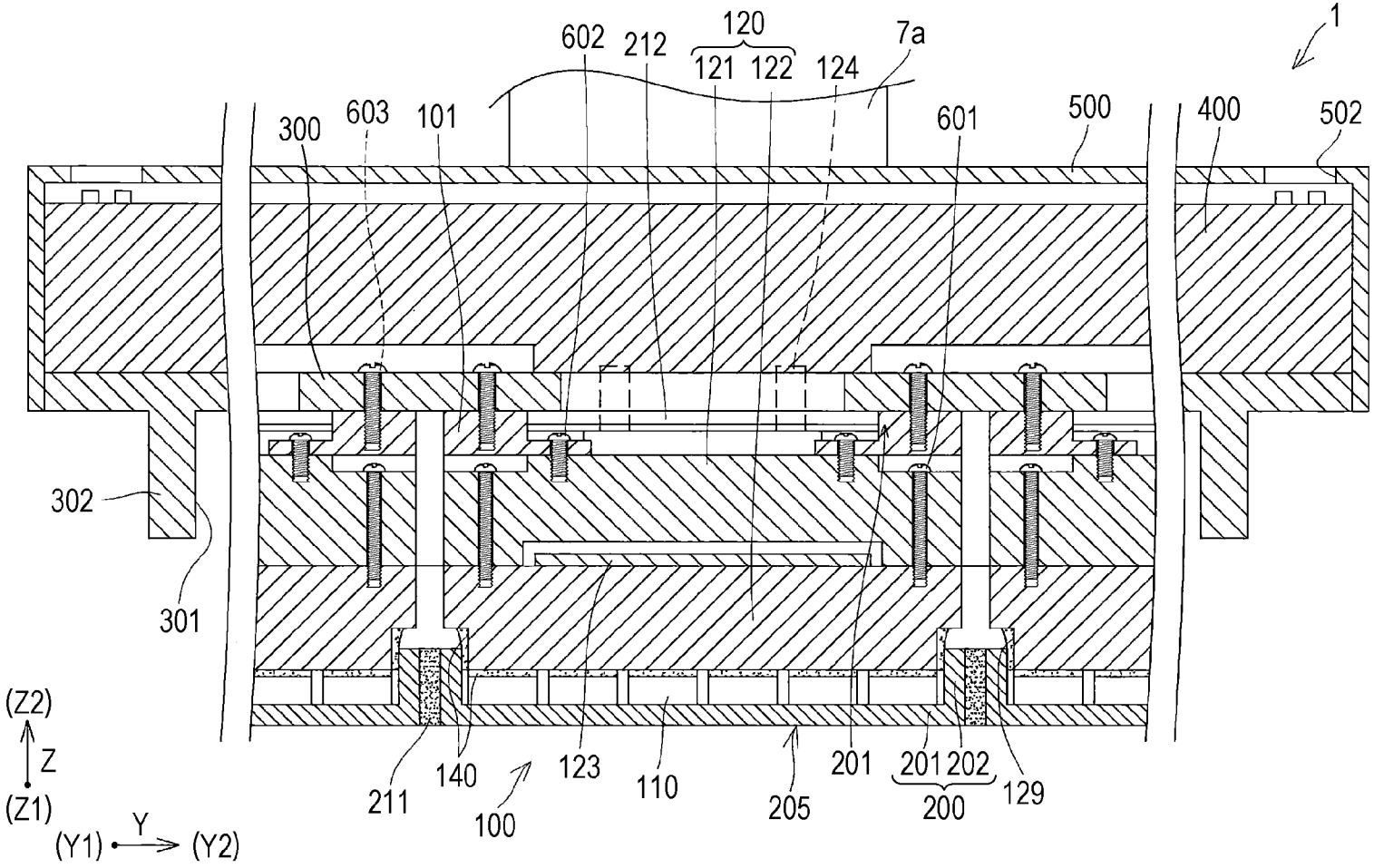
FIG. 12 is a sectional view of main portions of the recording head according to Embodiment 2.

FIG. 11 is a plan view from the liquid ejecting surface side of the recording head according to Embodiment 2 of the invention, and FIG. 12 is a sectional view of main portions taken along line XII-XII' of FIG. 11. In addition, the same reference numerals will be given to the same members as those in the above-described embodiment, and overlapping description will be omitted.

As illustrated in FIGS. 11 and 12, the recording head 3 includes: the plurality of covers 200 provided in a state of being separated from each other; the plurality of second conduction portions 210 for conducting the cover 200 and the base 300; and a void conduction portion 211 provided between the covers 200 adjacent to each other in the second direction Y, has conductivity, and conducts the covers 200 to each other.

The void conduction portion 211 is provided so as to close the voids of the covers 200 adjacent to each other in the second direction Y. In other words, the void conduction portion 211 is provided so as to close the openings on the Z1 side in the voids of the covers 200 adjacent to each other in the second direction Y. In this manner, by closing the voids between the adjacent covers 200 with the void conduction portion 211, it is possible to prevent ink from entering the voids between the covers 200 adjacent to each other. In addition, it is preferable that the void conduction portion 211 be provided so as to close the opening on the side surface in the first direction X in the void of the cover 200. Accordingly, it is also possible to suppress the entering of ink from the opening on the side surface in the first direction X. It is needless to say that the void conduction portion 211 is not limited to one that closes all the openings on the Z1 side of the covers 200 that are adjacent to each other, and for example, the void conduction portion may close only a part of the opening on the Z1 side of mutually adjacent covers 200.

It is preferable that the void conduction portion 211 be attachably and detachably provided to at least one of the covers adjacent to each other. Accordingly, it is possible to easily attach and detach the head main body 100 integrated with the cover 200 from the base 300, and to easily position the relative positions of the nozzle openings 21 of the head main body 100. In addition, a case where the void conduction portion 211 is attachable and detachable to and from at least one of the covers 200 adjacent to each other means, for example, that the void conduction portion 211 is fixed to one of the covers 200 adjacent to each other and in an abutting state as a pressure is applied by being biased to the other one of the covers 200. In addition, a state where the void conduction portion 211 is fixed to at least one of the mutually adjacent covers 200 with screws or the like, is also included. In other words, the cover 200 may have a configuration in which easy attachment and detachment to and from at least one of the covers 200 are possible. It is needless to say that the void conduction portion 211 may be attachably and detachably provided in both of the covers 200 adjacent to each other. As such a configuration, for example, a case where the void conduction portion 211 is fixed to the base 300 and is in an abutting state by being biased to both of the covers 200 adjacent to each other, is employed.

As such a void conduction portion 211, it is appropriate to use a porous metal material, such as metal fiber or foamed metal. By using a porous metal material as the void conduction portion 211 as described above, it is possible to easily attach and detach to and from at least one of the covers 200 adjacent to each other. In other words, since the void conduction portion 211 made of a porous metal material can be held in the voids of the covers 200 adjacent to each other by the elastic force, it is also possible to attach and detach the void conduction portion 211 to and from both of the covers 200 adjacent to each other, and to attach and detach the void conduction portion 211 to the other one of the covers by fixing the void conduction portion 211 to one of the covers 200 adjacent to each other.

In addition, by using the void conduction portion 211 made of a porous metal material, even when the ink adheres to the void conduction portion 211, the ink is likely to stick to the meniscus, and it is possible to hold the ink in the voids between the adjacent covers 200 in the second direction Y. Therefore, it is possible to prevent the ink held in the void of the cover 200 from dropping at an unexpected timing, soiling the recording sheet S.

By providing the void conduction portion 211 as described above, it is possible to conduct the covers 200 adjacent to each other. Therefore, it is possible to suppress grounding failure by increasing the number of second conduction portions 210 for grounding one cover 200. In addition, by making the arranged covers 200 conduct to each other, it is possible to further suppress the occurrence of the amplification and directivity of the cover 200 similar to a loop antenna in the direction in which the covers 200 are arranged.

In addition, in the embodiment, although the porous metal material is exemplified as the void conduction portion 211, the material of the void conduction portion 211 is not particularly limited thereto, for example, the void conduction portion 211 may be a plate spring or a coil spring. In addition, the void conduction portion 211 may be a conductive wire or the like. Furthermore, the void conduction portion 211 may be a conductive adhesive, solder, or the like. However, in a case where a conductive adhesive or solder is used as the void conduction portion 211, since the adjacent covers 200 adhere to each other, it is difficult to attach and detach the head main body 100 provided with the cover 200.

In addition, in the embodiment, the two second conduction portions 210 are provided in each of the covers 200, but the invention is not particularly limited thereto, and for example, the second conduction portions 210 which conduct the cover 200 on both sides in the second direction Y which is the arrangement direction, may further be added with respect to the covers 200 in both of the end portions in the second direction Y which is the arrangement direction of the arranged covers 200. Accordingly, it is possible to reliably perform the grounding at both of the end portions of the plurality of covers 200 conducted by the void conduction portion 211 in the arrangement direction.

As described above, in the recording head 3 of the embodiment, there are plural head chips 110 and plural covers 200 which are conductive members, respectively, the plurality of covers 200 are disposed in a state of being separated from each other, and the covers 200 adjacent to each other are conducted by the void conduction portion 211. By conducting the plurality of separated covers 200 by the void conduction portion 211 in this manner, it is possible to connect the plurality of covers 200 to the ground by conducting the plurality of covers 200 to each other. Therefore, it is possible to suppress connection failure of the cover 200 to the ground, and to suppress generation of amplification and directivity of the cover 200 similar to the loop antenna in the arrangement direction of the covers 200.

In addition, it is preferable that the void conduction portion 211 be a porous metal. In this manner, by using the porous metal as the void conduction portion 211, it is possible to hold the ink adhering to the void conduction portion 211 of the void between the covers 200 adjacent to each other, and to prevent the ink from falling unexpectedly.

In addition, it is preferable that the void conduction portion 211 closes the voids between the covers 200 adjacent to each other. In this manner, by closing the voids between the adjacent covers 200 with the void conduction portion 211, it is possible to prevent ink from entering the voids between the covers 200 adjacent to each other.

In addition, it is preferable that the void conduction portion 211 be attachably and detachably provided to at least one of the covers 200 adjacent to each other. In this manner, by making the void conduction portion 211 attachable and detachable to and from at least one of the covers 200 adjacent to each other, it is possible to easily attach and detach the head main body 100 integrated with the cover 200 from the base 300. Therefore, it is possible to easily perform maintenance, such as cleaning that requires exchange or attachment and detachment of the head main body 100.

Other Embodiments

Although the embodiments of the invention have been described above, the basic configuration of the invention is not limited to the above-described one.

For example, in each of the above-described embodiments, the configuration in which the recording head 3 has the plurality of covers 200 has been exemplified, but the invention is not particularly limited thereto, and one cover 200 may be provided commonly to a plurality of head main bodies 100. In addition, without providing the cover 200, instead of the cover 200, a nozzle plate 20 having conductivity, such as metal, may be provided. In other words, the nozzle plate 20 having conductivity may also serve as a cover substantially. In other words, the conductive member provided between the head chip 110 and the recording sheet S which is the ejecting medium is a member formed of a conductive material provided between at least one of the piezoelectric actuator 13 which is the pressure generating element of the head chip 110 and the driving circuit 112 having the switching element, and the recording sheet S, may be the cover 200, or may be the nozzle plate 20 provided in each of the head chips 110.

In addition, in the above-described embodiment, a configuration in which the cover 200 which is a conductive member that configures the shield is disposed between the piezoelectric actuator 13 which is the pressure generating element of the head chip 110 and the driving circuit 112 having the switching element, and the recording sheet S, is exemplified, but the invention is not particularly limited thereto, and the cover 200 may be positioned between at least one of the pressure generating element and the switching element and the recording sheet S. For example, even when the switching element is disposed on the side opposite to the recording sheet S of the cover 200, and the pressure generating element is disposed on the recording sheet S side of the cover 200, it is possible to protect the switching element by the cover 200.

In addition, in the above-described embodiment, a configuration in which the recording head 3 includes the head main body 100, the cover 200, the base 300, the distribution flow path member 400, and the base cover 500, is exemplified, but the invention is not limited thereto, and for example, the recording head may not be provided with the base 300, the distribution flow path member 400, and the base cover 500. In other words, the head main body 100 may substantially correspond to the recording head.

In addition, in each of the above-described embodiments, the arrangement direction of the plurality of head main bodies 100 held by the base 300 is defined as the second direction Y which is a direction perpendicular to the first direction X that is the transport direction of the recording sheet S, but the invention is not limited thereto, and the recording head in which the head main bodies 100 are arranged in the longitudinal direction of the base 300 may be disposed such that the direction in which the plurality of head main bodies 100 are aligned achieves an angle intersecting with the first direction X that is the transport direction of the recording sheet S, that is, an angle which is smaller than that in the first direction X by 90 degrees. At this time, in the in-plane direction of the nozzle surface 20*a*, even when the nozzle rows are provided in the direction perpendicular to the longitudinal direction of the base 300, by inclining the entire recording head, it is possible to dispose the nozzle rows inclined in the first direction X which is the transport direction.

In addition, in each of the above-described embodiments, a plurality of head main bodies 100 are provided in one recording head 3, but the invention is not particularly limited thereto, and one head main body 100 may be provided for one recording head 3.

In addition, in each of the above-described embodiments, disposition in which the fourth direction Xa which is the arrangement direction of the nozzle openings 21 of the head chip 110 are arranged in the head chip 110, is a direction inclined with respect to the second direction Y perpendicular to the first direction X that is the transport direction, is employed, but the fourth direction Xa which is the arrangement direction of the nozzle openings 21 may be the same direction as the first direction X which is the transport direction, or the fourth direction Xa which is the arrangement direction of the nozzle openings 21 may be the same direction as the second direction Y. Furthermore, the nozzle openings 21 are not limited to those provided in a row, and the nozzle openings 21 may be disposed in a matrix. Furthermore, in the above-described Embodiment 1, the holding member 120 is formed into a substantial parallelogram shape when viewed in a plan view from the third direction Z perpendicular to the nozzle surface 20*a*, but the invention is not limited thereto, and the shape may be rectangular shape, a trapezoidal shape, or a polygonal shape.

Furthermore, in each of the above-described embodiments, a so-called line type recording apparatus is described as the ink jet type recording apparatus 1 in which the recording head 3 is fixed to the apparatus main body 2 and the printing is performed only by transporting the recording sheet S, but the invention is not limited thereto, and can be employed in a so-called serial type recording apparatus that performs printing while moving the recording head 3 in a direction intersecting with the first direction X that is the transport direction of the recording sheet S, for example, while moving the recording head 3 in a direction intersecting with the transport direction after loading the recording head 3 onto a carriage that moves in the second direction Y. In addition, the configuration is not limited to the configuration in which the recording sheet S is transported to the recording head 3, and printing may be performed by the configuration in which the recording head 3 is moved with respect to the recording sheet S, or the recording sheet S may be relatively transported to the recording head 3.

Furthermore, the invention is broadly applicable to liquid ejecting heads in general, and examples thereof include recording heads, such as various types of ink jet type recording heads used in image recording apparatus, such as printers, a color material ejecting head used for manufacturing a color filter, such as a liquid crystal display, an electrode material ejecting head used for forming electrodes, such as an organic EL display or an field emission display (FED), and a bioorganic material ejecting head used for manufacturing a bio chip.

CROSS-REFERENCE TO RELATED APPLICATIONS

This application claims priority to Japanese Patent Application No. 2017-086950 filed on Apr. 26, 2017. The entire disclosures of Japanese Patent Application No. 2017-086950 are hereby incorporated herein by reference.

What is claimed is:

1. A liquid ejecting head comprising: a head chip configured to eject a liquid based on an electric signal; a first conductive path for connecting the head chip to a ground on the outside of the liquid ejecting head; and a second conductive path for connecting a shield of the head chip to the ground on the outside of the liquid ejecting head, wherein the first conductive path and the second conductive path are in an electrically isolated state within the liquid ejecting head.

2. The liquid ejecting head according to claim 1,
wherein the shield is a conductive member formed of a conductive material provided between the head chip and an ejecting medium onto which the liquid ejected by the head chip is to be landed.

3. The liquid ejecting head according to claim 2,
wherein a plurality of the head chips and a plurality of the conductive members are provided,
wherein the plurality of conductive members are disposed in a state of being separated from each other, and
wherein the conductive members which are mutually adjacent are conducted to each other by a conductor.

4. A liquid ejecting apparatus comprising:
the liquid ejecting head according to claim 3; and
an apparatus main body which supports the liquid ejecting head.

5. A liquid ejecting apparatus comprising:
the liquid ejecting head according to claim 2; and
an apparatus main body which supports the liquid ejecting head.

6. The liquid ejecting head according to claim 2,
wherein the head chip includes a nozzle plate being formed a nozzle opening for ejecting a liquid.

7. The liquid ejecting head according to claim 6,
wherein the nozzle plate is formed silicon.

8. The liquid ejecting head according to claim 7,
wherein the conductive member is a cover covering the nozzle plate.

9. The liquid ejecting head according to claim 2, wherein the head chip includes a nozzle plate being formed a nozzle opening for ejecting a liquid, the conductive member is a cover covering the nozzle plate, a plurality of the head chips and a plurality of the covers are provided, the plurality of covers are disposed in a state of being separated from each other, and the covers which are mutually adjacent are conducted to each other by a conductor.

10. The liquid ejecting head according to claim 1, wherein the first conductive path and the second conductive path are conducted to each other via a noise canceller.

11. A liquid ejecting apparatus comprising:

the liquid ejecting head according to claim 10; and an apparatus main body which supports the liquid ejecting head.

12. A liquid ejecting apparatus comprising:

the liquid ejecting head according to claim 1; and an apparatus main body which supports the liquid ejecting head.

13. The liquid ejecting apparatus according to claim 12, wherein the liquid ejecting head and the apparatus main body are connected to each other via an attachable and detachable connector.

14. The liquid ejecting apparatus according to claim 12, wherein the liquid ejecting head is provided so as to be relatively movable with respect to the apparatus main body.

15. The liquid ejecting apparatus according to claim 12, further comprising:

a circuit board having the ground.

16. The liquid ejecting apparatus according to claim 12, wherein the first conductive path is connected to the earth or connected to the ground by an outlet plug that is plugged into an outlet plug of a commercial power supply, and wherein the second conductive path is connected to the earth.

17. The liquid ejecting apparatus according to claim 12, wherein the second conductive path connects to, not via the first conductive path, a frame ground connected to the apparatus main body.

18. The liquid ejecting apparatus according to claim 12, wherein the second conductive path comprise a conductive biasing member configured to control relative movement of the liquid ejecting head with respect to the apparatus main body in a transport direction of a recording medium advanced below the liquid ejecting head.

19. The liquid ejecting head according to claim 1, wherein the first conductive path and the second conductive path are in an electrically isolated state within the liquid ejecting head by providing an insulating member between the first conductive path and the second conductive path.

20. The liquid ejecting head according to claim 1, wherein a portion of the second conductive path supports a relay board of the first conductive path, and the relay board and the portion of the second conductive path are in an electrically isolated state.

* * * * *